US005102301A

United States Patent [19]

Morrison

[11] Patent Number: 5,102,301

[45] **Date of Patent: * Apr. 7, 1992**

[54] VARIABLE PITCH PROPELLER BLADES, HUB AND DRIVE AND ADJUSTING MECHANISM THEREFOR

[76] Inventor: Douglas M. Morrison, Box 733-A, Hwy. 304, Thibodaux, La. 70301

[ * ] Notice: The portion of the term of this patent subsequent to May 21, 2008 has been disclaimed.

[21] Appl. No.: 678,721

[22] Filed: Apr. 1, 1991

Related U.S. Application Data

[60] Continuation-in-part of Ser. No. 308,329, Feb. 7, 1989, and a continuation-in-part of Ser. No. 600,673, Oct. 22, 1990, which is a division of Ser. No. 308,329, , said Ser. No. 308,329, is a continuation-in-part of Ser. No. 174,428, Mar. 28, 1988, abandoned.

[51] Int. Cl.[5] ..... B63H 3/00; B63H 1/00

[52] U.S. Cl. ..... 416/163; 416/165 R; 416/223 R

[58] Field of Search ..... 416/247 A, 208, 209, 416/234, 239, 237 R, 223 R, 248, 212 R, 214 R, 222, 147, 163, 164, 168, 166

[56] References Cited

U.S. PATENT DOCUMENTS

| | | | |
|---|---|---|---|
| 494,014 | 3/1893 | McGlasson | 416/168 |
| 573,977 | 12/1896 | Hubbard | 416/166 |
| 655,958 | 8/1900 | Carlsson | 416/237 |
| 810,032 | 1/1906 | Brown | 416/167 |
| 833,364 | 10/1906 | Arthur | 416/237 |
| 1,332,475 | 3/1920 | Spitler | 416/163 |
| 1,407,080 | 2/1922 | Overturf | 416/167 |
| 1,491,589 | 4/1924 | Dzus | 416/39 |
| 1,546,554 | 7/1925 | Ross | 416/237 |
| 1,713,446 | 5/1929 | Peterson | 416/247 A |
| 1,779,050 | 10/1930 | Schroder | 416/168 |
| 1,806,325 | 5/1931 | Wooden | 416/205 |
| 1,896,280 | 7/1932 | Roemisch | 156/418 |
| 2,084,655 | 12/1935 | Roberts | 416/166 |
| 2,282,243 | 5/1942 | Taylor | 416/234 |
| 2,354,465 | 7/1944 | Le Bert | 416/147 |
| 2,391,011 | 3/1893 | Raulerson | 416/168 |
| 2,470,517 | 5/1949 | Obrist | 416/220 R |
| 2,478,244 | 8/1949 | Cooley | 416/163 |
| 2,554,716 | 5/1951 | Melius | 416/239 |
| 2,684,654 | 7/1954 | Johnson | 416/237 R |
| 2,711,796 | 6/1955 | Amiot | 416/152 |
| 2,870,848 | 1/1959 | Liaaen | 416/157 R |
| 2,885,013 | 5/1959 | Steiner | 416/163 |
| 2,939,334 | 6/1960 | Beckjord | 416/167 X |
| 2,953,208 | 9/1960 | O'Connor | 416/147 |
| 3,027,864 | 4/1962 | Polson | 416/247 A |
| 3,082,826 | 3/1963 | Doman et al. | 416/163 |
| 3,095,932 | 7/1963 | Hercules | 416/166 |
| 3,122,207 | 2/1964 | Mades | 416/151 |
| 3,138,136 | 6/1964 | Nichcols | 167 X/237 |
| 3,282,351 | 11/1966 | Troutman | 416/167 |
| 3,518,022 | 6/1970 | Adams | 416/27 |
| 3,794,441 | 2/1974 | Johnson | 416/167 |
| 3,795,463 | 3/1974 | Herbert | 416/207 |
| 4,842,483 | 6/1989 | Geary | 416/93 A |
| 5,017,090 | 5/1991 | Morrison | 416/168 |

FOREIGN PATENT DOCUMENTS

| | | | |
|---|---|---|---|
| 137048 | 5/1947 | Australia | 416/168 |
| 463179 | 2/1950 | Canada | 416/163 |
| 141151 | 7/1903 | Fed. Rep. of Germany | 416/163 |
| 727968 | 11/1942 | Fed. Rep. of Germany | 416/136 |
| 467096 | 12/1914 | France | 416/168 |
| 538548 | 6/1922 | France | 416/166 |
| 686214 | 7/1930 | France | 416/163 |
| 1177427 | 6/1957 | France | 416/168 |
| 453536 | 12/1949 | Italy | 416/167 |
| 547875 | 9/1956 | Italy | 416/164 |
| 45-5844 | 2/1970 | Japan | 416/168 |
| 57-46091 | 3/1982 | Japan | 416/167 |
| 28468 | 3/1917 | Norway | 416/166 |
| 343777 | 2/1931 | United Kingdom | 416/167 |
| 614731 | 12/1948 | United Kingdom | 416/164 |
| 2168435 | 6/1986 | United Kingdom | 416/166 |

*Primary Examiner*—Edward K. Look

*Assistant Examiner*—Hoang Nguyen

*Attorney, Agent, or Firm*—John F. Sieberth

[57] ABSTRACT

Stern drive propulsion systems for boats in which there is at least one prime mover (outboard or inboard motor) and a power train for rotating at least one propeller in the water to propel the boat are improved by inclusion therein of novel variable pitch propellers, and a novel pitch adjusting propulsion system. The system includes a blade and hub mechanism that can propel the boat forwardly and in reverse with great maneuverability, and cut through mud and thick vegetation without becoming fouled, as well operate the boat at high speeds in open water.

29 Claims, 12 Drawing Sheets

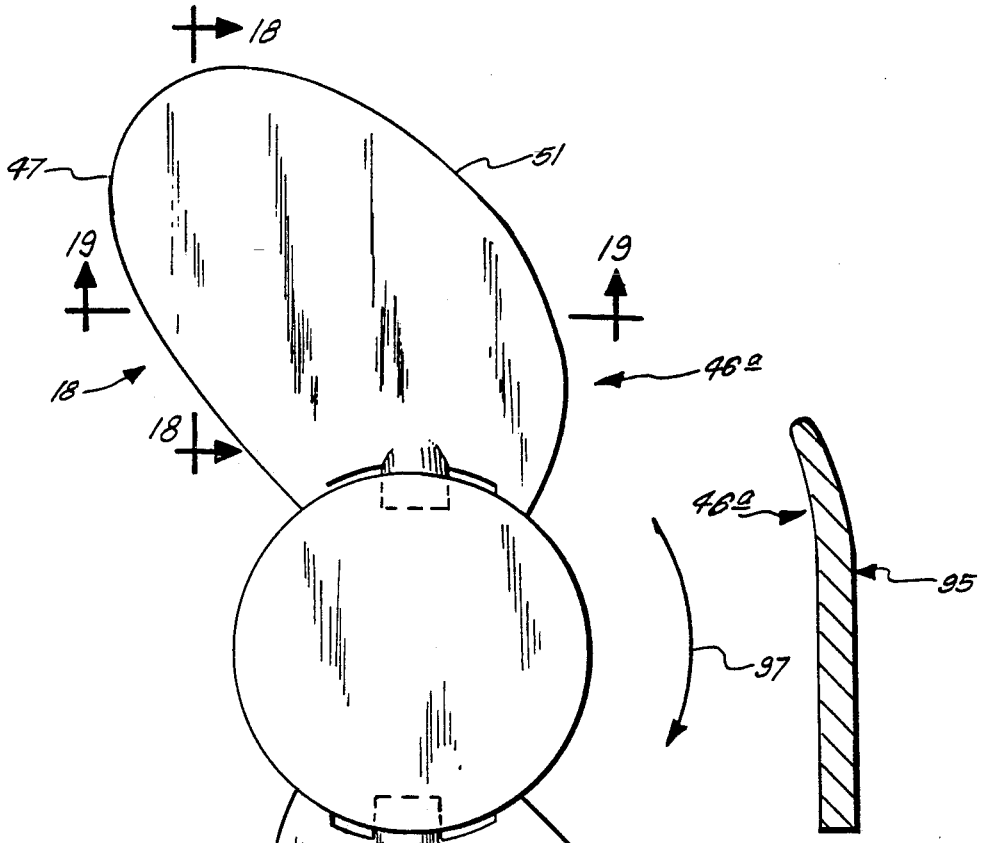
FIG. 18.
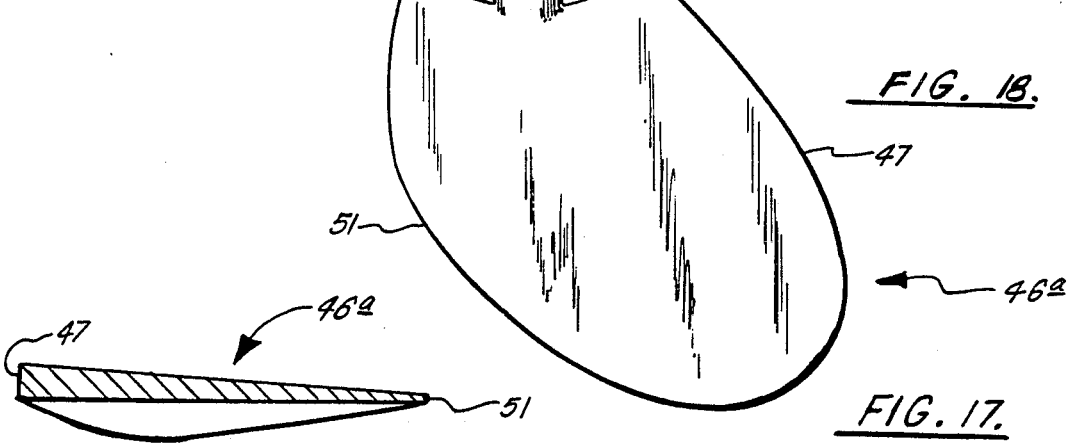
FIG. 17.
FIG. 19
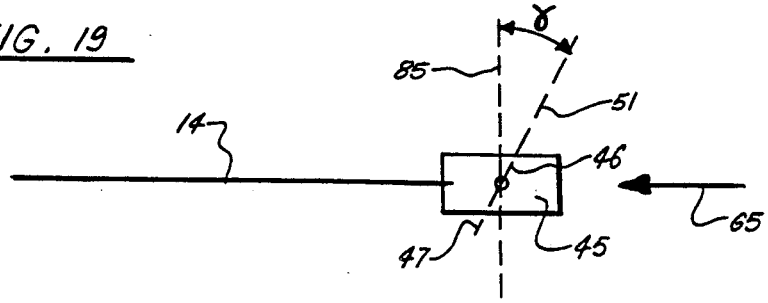
FIG. 24.

VARIABLE PITCH PROPELLER BLADES, HUB AND DRIVE AND ADJUSTING MECHANISM THEREFOR

REFERENCE TO RELATED APPLICATIONS

This is a continuation-in-part of copending application Ser. No. 308,329, filed Feb. 7, 1989, which in turn is a continuation-in-part of application Ser. No. 174,428, filed Mar. 28, 1988, now abandoned. This application is also a continuation-in-part of copending application Ser. No. 600,673, filed Oct. 22, 1990, which in turn is a division of said Ser. No. 308,329. The disclosures of all said applications are incorporated herein by reference.

TECHNICAL FIELD

This invention relates to means for controlled propulsion of boats, and in this context to new, useful and highly efficacious variable pitch propeller blade constructions, and drive and adjusting mechanisms for such propellers.

BACKGROUND

Various mechanisms for adjusting the pitch of rotatable blades (propellers, fan blades, etc.) have been described heretofore. See for example U.S. Pat. Nos. 494,014; 573,977; 810,032; 1,332,475; 1,407,080; 1,491,589; 1,779,050; 1,806,325; 1,869,280; 2,084,655; 2,354,465; 2,394,011; 2,470,517; 2,478,244; 2,711,796; 2,870,848; 2,885,013; 2,939,334; 3,122,207; 3,138,136; 3,518,022; 3,795,463; Canadian 463,179; French 1,177,427; Italy 547,875; and Japan 57-46091.

Although differently shaped blades have been described for use in driving a boat or other vessel through water, the most commonly used type involves a blade having a helically shaped (twisted) configuration.

Heretofore, when flat bottom boats or other boats of shallow draft entered marshy areas choked with vegetation or thick muddy areas covered with but a few inches of water—situations which can readily be encountered in swamps such as exit in southern Louisiana and in other swampy regions—it was very likely that the boats would become mired and bogged down so that they could not move in any direction. Contributing to the problem was the fact that the driving mechanisms for small boats available on the open market rotate in only one direction and are equipped with helically twisted propellers that can readily become entangled in thick vegetation.

SUMMARY OF THE INVENTION

An object of this invention is to provide new, useful and highly efficacious variable pitch propeller blade constructions which work well in propelling boats, especially flat bottom boats, through very shallow water, or mud, or swampy or marshy areas, even those choked with vegetation.

A further object is to provide a variable pitch propeller blade configuration which when used with conventionally sized and rated outboard motors or engines (e.g., 10–25 hp) provides the power needed to drive flat bottom boats and other boats of shallow draft through wet muds and marshes, even when the area is choked with swamp grasses and other similar vegetation commonly encountered in swampy and marshy areas.

Still another object is to provide a variable pitch propeller blade configuration which can be used to propel the boat—including flat bottom boats—through wet muds and marshes under conditions of the type just described, yet which can propel the very same boat at a relatively high rate of speed through open water, again without need for more powerful motors or engines than are customarily used as outboard motors for boats.

Yet another object is to provide variable pitch propeller blades that can be adjusted by the operator through a continuum of positions ranging from fast forward to fast reverse so that the boat can be operated at a full range and variety of speeds, can be stopped rapidly, and can be maneuvered with precision.

A further object is to provide a propeller blade configuration and mechanism enabling the operator to run the boat at any particular speed within a continuous range of speeds, and, without changing engine speed, swiftly stop the boat and even reverse its direction of movement if the need or desire to do so arises.

Another object is to provide a mechanism that will enable the operator to run the boat at very slow or fast speeds with a minimum of noise.

Still another object is to provide a propeller blades and propeller blade assemblies that can be serviced and repaired easily and quickly.

These and other objects, features and embodiments of this invention will become further apparent as the discussion proceeds.

In accordance with one embodiment of this invention a variable pitch propeller blade is provided in which the blade is of generally planar configuration, i.e., there is no twist or helical configuration in the blade. One portion of the blade (the leading edge portion) is relatively thin and another portion (a median and/or a trailing edge portion) is somewhat thicker to provide the necessary strength and rigidity to the blade. The blade is configured such that the thin leading edge portion of the blade has a swept back or retracted curvature along a substantial portion of its length when proceeding in the direction of inner end to outer end. While such blades may have generally convex or concave outer surfaces (faces), it is preferable that they have substantially flat outer surfaces. In other words, the front and rear faces of such blades may be convex or slightly concave between the leading and trailing edge portions, but preferably, are substantially flat between the leading and trailing edge portions. Affixed to the inner ends of each such blade is a means (preferably a cylindrical stub or the like) for rotating the blade in a continuous series of planes whereby the position of the blade can be adjusted to and from a fast forward position through neutral and to and from a fast reverse position, and can be set at any and all stages therebetween so that the boat may be operated in either direction (forward or reverse) without adjusting the speed of the engine and can be manuevered with quick response and precision. Indeed, these blades enable the boat to be rocked back and forth while the boat is being turned in a very small space, and this in turn enables the boat to be disengaged from thick vegetation rather than becoming mired and bogged down as is the case with boats equipped with conventional propellers and propulsion systems. When the blade is in a forward propelling position the leading or sharp edge of the blade projects forwardly of the plane which is perpendicular (transverse) to the axis of the propeller shaft. When the blade is in a rearward propelling position the leading or sharp edge of the blade projects rearwardly of the plane perpendicular (transverse) to the axis of the propeller shaft). And when the blade is in its neutral position (propelling neither forwardly or rearwardly) the plane of the blade falls substantially along the plane which is perpendicular (transverse) to the axis of the propeller shaft. The angular displacement between the plane of the blade and the perpendicular plane governs the speed at which the boat will be propelled: the greater the angle, the higher the speed. For most types of general service, provision will be made to allow the angular displacement between the plane of the blade and the perpendicular plane to be adjusted to as much as 45° in both forward and reverse. However the limits of adjustment for these ranges may be varied as deemed necessary or desirable. Normally, and preferably, these stubs in turn will be received within a hub containing a suitable mechanism for applying a rotational torque to the stubs to rotate the stubs about their respective axes and thereby rotate the planar blades and adjust their pitch while at the same time causing the blades to be rotated about the axis of the propeller shaft so that the leading edge is always the forwardmost portion of the blade cutting into the water (whether operating in forward, reverse or neutral). In a preferred embodiment two such blades are disposed on and extend from opposite sides of a rotatable hub and are operatively connected to means for translating linear motion into axial rotational torque upon the blade stubs for adjusting the pitch of the blades as desired by the operator.

Flat planar blades of the type described in the immediately preceding paragraph generate the greatest amount of power both in the forward and rearward directions. Thus such essentially flat planar blades with a relatively sharp leading edge portion and a relatively thicker median and/or trailing edge portion are preferred for use in mud boats and other similar flat bottom boats to be used in swamps and marshes, especially where the water is as shallow as one to two inches or less, and where thick mud and/or heavy vegetation may be encountered. For convenience these blades will often be referred to hereinafter as the "flat planar blades".

In another embodiment of this invention a variable pitch propeller blade of the type described above is provided differing in that the plane of the blade is curved or bent along its length. The curvature commences at a locus at least about one-half (preferably between about one-half and about three-fourths, most preferably about two-thirds) the distance from the innermost portion of the blade to the outermost portion of the blade. The direction of the bend is always toward the front of the boat. Thus there are basically two such curved blade configurations, depending upon the direction in which the hub and blades are to be rotated. If the propeller drive train is arranged so that the hub and blades rotate clockwise (when viewed from behind the propeller and looking in the direction of forward boat travel) the plane of the blade curves toward the front of the boat and when the blades are in the 12 o'clock position, the relatively sharp leading edge is toward the right hand. However, if the propeller drive train is arranged so that the hub and blades rotate counterclockwise (when viewed from behind the propeller and looking in the direction of forward boat travel) the plane of the blade again curves toward the front of the boat, but when the blades are in the 12 o'clock position, the relatively sharp leading edge is toward the left hand side. It is to be noted that although the outer end portion of the blade is bent in the appropriate direction (i.e., toward the front of the boat), the blade is not helically twisted. Rather, the blade when viewed edgewise is substantially flat, but bent along an outer portion of its length. For convenience these blades will often be referred to hereinafter as the "bent planar blades", and collectively the "flat planar blades" and the "bent planar blades" will often be referred to collectively hereinafter as the "planar blades". It will thus be understood that in all cases the planar blades have a relatively sharp, outwardly receding or retracted (swept back) leading edge and a somewhat thicker median zone or trailing edge (which may itself be rounded off, squared off or even tapered down in thickness for a short distance), and most preferably their front and rear faces are substantially flat (as distinguished from being radially twisted).

The bent planar blades generally do not generate quite as much power in the forward and rearward directions as the flat planar blades, yet they still can provide enough power to move even flat bottom boats through reasonably thick muds and marshes. An advantage of the bent planar blades is that they make possible the attainment of higher boat speeds than the flat planar blades. Accordingly the bent planar blades represent an excellent compromise between speed and power, and are thus well suited for use in mud boats and other similar flat bottom boats to be used both in open water and in swamps and marshes, even where water as shallow as one to two inches and where mud and/or vegetation may be encountered.

The receding or swept back (retracted) curved leading edge is one of the very important features enabling the blades, especially the flat planar blades, to cut through thick muds covered with but a few inches of water or through marshy areas choked with vegetation such as swamp grasses, water lilies, and the like. This and the fact that the planar blades of this invention are adapted to be rotated on the axis of their stubs enables the blades to maneuver the boats back and forth with great precision in extricating the boat from thickly vegetated areas, to cut through snags and snares that would tend to foul conventional propellers, and to shed vegetation that would choke and foul conventional propellers. Helically twisted and even planar blades that are paddle shaped with more or less convex leading and trailing edges are incapable of performing effectively under such conditions. Likewise planar blades with more or less straight leading edges cannot operate effectivly under these conditions.

It will be appreciated that the receding or swept back (retracted) curved leading edge need not be (but preferably is) composed of a smooth uninterrupted curve. In lieu thereof the curvature of the swept back leading edge may include in whole or in part a series of short straight adjacent segments arranged tangentially on an imaginary smooth curved leading edge with the segments successively intersecting each other so that the overall effect is one of approximating a smooth retracted curved leading edge by means of such short adjacent straight segments. Similarly, the smooth retracted curved leading edge may be interrupted along its length by one or more spaced-apart short segments of this type whereby once again a smooth retracted curved leading edge is closely approximated. Further, the swept back leading edge may be smooth or serrated.

In accordance with a particularly preferred embodiment of this invention at least the innermost end of the leading edge of each planar blade is in very close proximity to, and most preferably projects from, an arcuate recess in the exterior of the hub, and most preferably such leading edge extends substantially tangentially from the hub for a short distance outwardly from the hub when the blade is in the neutral position—i.e., when the blade has been rotated on its axis such that the leading edge of the blade falls in a plane perpendicular to the axis of the hub and propeller shaft. The arcuate recess in the hub serves a twofold purpose. First, it enables the inner end of the leading edge to be in direct or substantially direct contact with the hub irrespective of the extent to which the blade is rotated radially about its axis. This prevents or at least greatly reduces the chances of vegetation or other debris becoming wedged or entangled between the blade and hub. Secondly, the lateral ends of the recess can serve as stops to prevent over-rotation of the blade in either direction when adjustments in blade pitch are being made. Such blades of course also possess the swept back curved leading edge described above. For convenience such blades are sometimes referred to hereinafter as the "grooved tangential swept back planar blades". In this connection, the term "grooved" is used in the sense that the inner end portion of the leading edge portion of the blade is positioned or is to be positioned such that it fits into an arcuate groove in the exterior of the hub—it does not mean that the blade itself is grooved. Experiments conducted under actual service conditions have shown that grooved tangential swept back flat planar blades of the type referred to in this paragraph can give the very best results as they most effectively (a) cut through mud and vegetation, (b) shed the cuttings, (c) avoid fouling at all locations on the blade and hub, (d) drive the boat at high speeds when conditions warrant, and (e) maneuver the boat under conditions where conventionally propelled boats would become bogged down and hopelessly mired in the swamp. Such blades are virtually foul-proof.

The blades of this invention can be utilized with any mechanism or system which enables the stubs on the blades to be axially rotated such that the pitch of the blades can be adjusted by the operator throughout the desired range of positions, and yet held fast in the selected position. However it is definitely preferred to utilize a variable pitch propeller drive and adjusting mechanism of the type described hereinafter. Thus in accordance with a further embodiment of this invention a variable pitch propeller drive and adjusting mechanism is provided which comprises (a) a hollow drive shaft terminating in a hub; (b) a pitch adjusting shaft rotatable with and longitudinally moveable in the drive shaft; (c) a pair of planar blades (of the types described hereinabove) each with a cylindrical stub on its inner end portion, the stubs extending into the hub through a pair of hereinafter-referred-to bearings; (d) means within the hub translating longitudinal movement of the pitch adjusting shaft into opposed rotational movement of the stubs about an axis perpendicular to and extending through the axis of the drive shaft; and (e) a pair of bearings mounted in and affixed to the hub to accommodate such rotational movement of the respective stubs; the apparatus being further characterized in that (f) the blade stubs within the hub are shaped to axially abut and rotatably engage each other; and (g) the pitch adjusting shaft is slidably fitted within one or more bushings or bearings mounted in the drive shaft.

The longitudinal position of the pitch adjusting shaft within the hollow drive shaft can be adjusted means of a control or shift lever mechanism. A feature of this invention is that the pitch of the planar bades can thus be adjusted through a continuum of positions ranging from fast forward to fast reverse without need for stops or other restraining means imposed on the shift lever. Undesired changes in the pitch of the planar blades due to torsional forces generated in the water by the rotation therein of the blades around the axis of the drive shaft can be successfully nullified without need for such stops or like restraining means. Without desiring to be bound by theoretical considerations, it is believed that at least two combined effects are responsible for such nullification. First, undesired changes in the pitch of the rotating planar blades is believed to be resisted by the axial abutment and rotatable engagement between the ends of the stubs within the hub. This mechanical arrangement is believed to couple and pit the torsion derived forces from the blades against each other so that these forces tend to neutralize each other. Secondly, it is believed that the friction of the slidable fit of the pitch adjusting shaft within the bearing(s) or bushing(s) in the drive shaft and the centrifugal forces generated by the drive shaft bearing(s) and the pitch adjusting shaft rotating in unison tend to resist undesired change in the longitudinal position of the pitch adjusting shaft in the drive shaft, and as a consequence these factors also tend to prevent undesired changes in the pitch of the planar blades as the blades rotate in the water around the axis of the drive shaft. Whatever the mechanism may be, the plain fact is that prototype systems of this invention have been constructed in the manner disclosed and depicted herein and found to work well in actual service for suitably long periods of time.

Another feature of this invention is that by eliminating the need for stops or other restraining means on the control or shift lever mechanism to prevent unwanted pitch changes in the planar blades, the planar blades can under special or emergency conditions be rotated around the axes of their stubs. For example, if the planar blades strike a submerged log or other substantial underwater obstacle, the extra torsional force imposed on them by such impact can override the factors normally holding the blades in their selected pitch positions and thus move the blades to another position, usually neutral or close thereto, and thereby reduce the likelihood of damage to the planar blades or to other parts of the over-all mechanism.

It will be appreciated that while stops or other restraining means on the control or shift lever mechanism are not required, they may be used, if desired. In other words, it is not necessary to the practice of this invention that the system be constructed so that such stops or other restraining means are unnecessary. If such stops or other restraining means are found necessary or desirable in any given type of construction, they should of course be used. In one preferred system of this invention when adapted for use with mud boats propelled with engines or other prime movers providing up to about 25 horsepower (hp), the only such restraining means used is a pair of stops to prevent the pitch of the planar blades to exceed about 45 degrees from neutral in the forward or reverse position and more preferably up to about 25 degrees in the reverse position, so as to prevent the engine speed and load from becoming excessive and causing possible damage to the engine. Within these extremes the pitch of the planar blades may be adjusted as a continuum. This makes it possible to maximize engine and boat performance which may vary from case to case depending on the size and characteristics of the particular engine, boat and planar blades used. As noted above, when grooved tangential swept back planar blades are used, the lateral ends of the grooves can serve as the stops in lieu of other forms of restraining means to prevent overrotation of the blades. However, other forms of restraining means associated with the control lever may be employed along with the grooves in order to keep the blades in specific positions within the limits afforded by the lateral ends of the grooves.

Thus, in a particularly preferred system of this invention adapted for use with mud boats propelled with engines or other prime movers providing up to about 25-35 horsepower, the retraining means used is comprised at least in part of an arcuate groove or recess in the hub into which is fitted the inner end of the leading edge portion of a planar blade, the leading edge of which extends substantially tangentially from the hub for a short distance outwardly from the hub when the blade is in the neutral position, the lateral ends of the arcuate groove serving as stops to prevent overrotation of the blades on their axes.

Another embodiment of this invention provides a variable pitch propeller drive and adjusting mechanism which is readily serviced (e.g., packed with grease or other suitable lubricant) and, if need be, repaired. This mechanism comprises (a) a hollow drive shaft; (b) an open-ended hollow housing mounted on the end of the shaft and rotatable therewith; (c) a hub end cap detachably secured to the housing to cover the open end thereof and thereby form a hollow hub; (d) a pitch adjusting shaft rotatable with and longitudinally moveable in the drive shaft; (e) a pair of planar blades (of the types described hereinabove) each with a cylindrical stub on its inner end portion, the stubs extending into the hub through a pair of bearings (referred to hereinafter); (f) means within the hub translating longitudinal movement of the pitch adjusting shaft into opposed rotational movement of the stubs about an axis perpendicular to and extending through the axis of the drive shaft; and (g) a pair of bearings in the hub to accommodate such rotational movement of the respective stubs, each such bearing comprising a split bushing with one-half of the bushing mounted in and affixed to a recess in the housing at its open end and the other half of the bushing mounted in and affixed to an opposed recess in the hub end cap. It will be seen that this construction enables ready access to the means within the hub translating longitudinal movement of the pitch adjusting shaft into opposed rotational movement of the stubs, these being the elements that require most servicing (lubrication).

In each of the foregoing embodiments other features of this invention may be and preferably are employed. For example, the means translating longitudinal movement of the pitch adjusting shaft into opposed rotational movement of the stubs comprises (i) a yoke mounted on the end of the pitch adjusting shaft, the yoke including a pair of ears extending longitudinally beyond the end of the pitch adjusting shaft; (ii) a pair of lobes, each integral with a respective stub and extending radially along an axis perpendicular to the axis of the stub thereby forming a crank thereon, said lobes extending in generally opposite directions from each other; and (iii) a pair of links, each pivotally connected to a respective ear of the yoke and to the crank of the proximate stub.

In mechanisms adapted for use in marshy areas containing marsh grasses or like vegetation, it is preferred that the drive shaft be rotatably supported within a casing, which casing has elongated substantially triangular fins mounted on and extending radially outwardly from opposite sides of its exterior such that the fins each provide in profile an inclined plane of progressively increasing height terminating in front of and in proximity to the transverse circular locus of rotation of the planar blades, the apex of such inclined plane extending radially to at least about the midpoint of the radial length of the blades. Another preferred feature for inclusion in such apparatus are (i) means for mounting a prime mover above the hollow drive shaft, and (ii) means for affixing an endless belt between the prime mover and the hollow drive shaft to enable the drive shaft to be rotated by the prime mover.

The variable pitch blades, variable pitch drive systems, and pitch adjusting mechanisms of this invention can be advantageously employed in combination with outboard and inboard stern drive propulsion systems by use of suitable coupling mechanisms. As is well known, it is customary to mount one or two outboard motors on the transom of the boat. In this case during normal operation the main drive shaft from the motor is in an upright position. Bevel gears or the like are used to translate rotary motion of the upright main drive shaft to the propeller shaft. Systems such as power hydraulic systems are available for "trimming" the outboard motor whereby the position of the entire unit can be altered such that the upright drive shaft can be inclined either forwardly toward the bow of the boat or rearwardly from the stern of the boat. Such trimming normally involves an angular displacement in the order of up to about 7° or 8° from true vertical. It is also known to mount outboard motor units on pivotal mounts so that in the event a submerged log or other obstacle is struck by the lower portion of the unit, the entire unit can pivot upwardly to enable it to ride over the submerged obstacle.

In inboard stern drive systems, the engine is mounted within the boat, and in this case the main drive shaft from the engine is in a prone position. Typically, this prone main drive shaft extends through the transom of the boat and is disposed either horizontally or inclined upwardly or downwardly by up to about 5° to 6° from the horizontal. For use in the systems of this invention, preferably the drive shaft is operatively connected through universal joint or like flexible coupling and a set of bevel gear to an upright power shaft which in turn is operatively connected by another set of bevel gears to the propeller shaft.

In accordance with this invention the coupling or operative interrelationship between such outboard or inboard stern drive systems is accomplished by providing, inter alia, the following embodiments:

Embodiment A: A variable pitch propeller and adjusting mechanism which comprises:

a) a hollow hub having disposed at locations around the exterior perimeter thereof a plurality of arcuate recesses; and having disposed on and extending from the hub a plurality of unitary propeller blades, each such propeller blade having (i) a planar configuration, (ii) an inner end portion, (iii) an outer end portion, (iv) a relatively sharp, outwardly swept back leading edge portion, and (v) a cylindrical stub axially aligned with the plane of the blade and affixed to the inner end portion of the blade, each said stub being adapted upon axial rotation to rotate the entire unitary blade to which it is affixed, the respective stubs of the blades extending radially into the hollow portion of the hub and adapted for axial rotation, at least the innermost end of the leading edge portion of the respective blades being disposed in and adapted for arcuate movement within at least a substantial portion of the respective arcuate recesses upon axial rotation of the respective stubs;

b) a pitch adjusting shaft axially aligned with and adapted to undergo linear motion relative to said hub;

c) means translating linear motion of said pitch adjusting shaft into opposed rotational movement of said stubs so that the pitch of the blades can be adjusted by such rotational movement of said stubs;

d) a pitch control rod adapted to undergo linear motion, said pitch control rod being angularly disposed relative to said pitch adjusting shaft; and e) means for converting linear motion of said pitch control rod into linear motion of said pitch adjusting shaft.

Embodiment B: The apparatus of Embodiment A) is modified by further including:

f) a pitch control shaft adapted to undergo linear motion and angularly disposed relative to said pitch control rod; and g) means for converting linear motion of said pitch control shaft into linear motion of said pitch control rod.

Embodiments C and D: In these embodiments, a stern drive propulsion system for a boat, which propulsion system comprises at least one prime mover and at least one power train for rotating at least one propeller below the surface of the water in order to propel the boat, is improved by including therewith the apparatus of Embodiment A or of Embodiment B, respectively.

Embodiment E: This embodiment involves improving a stern drive propulsion system for a boat, which propulsion system comprises at least one prime mover and at least one power train for rotating at least one propeller below the surface of the water in order to propel the boat, by including with such propulsion system:

a) a rotatable hollow drive shaft having a hollow hub affixed thereto, said hub having disposed at locations around the exterior perimeter thereof a plurality of arcuate recesses; and having disposed on and extending from the hub a plurality of unitary propeller blades, each such propeller blade having (i) a planar configuration, (ii) an inner end portion, (iii) an outer end portion, (iv) a relatively sharp, outwardly swept back leading edge portion, and (v) a cylindrical stub axially aligned with the plane of the blade and affixed to the inner end portion of the blade, each said stub being adapted upon axial rotation to rotate the entire unitary blade to which it is affixed, the respective stubs of the blades extending radially into the hollow portion of the hub and adapted for axial rotation, at least the innermost end of the leading edge portion of the respective blades being disposed in and adapted for arcuate movement within at least a substantial portion of the respective arcuate recesses upon axial rotation of the respective stubs;

b) a pitch adjusting shaft disposed in said hollow drive shaft and longitudinally moveable therein, said pitch adjusting shaft being axially aligned with and adapted to undergo linear motion relative to said hub;

c) means translating linear motion of said pitch adjusting shaft into opposed rotational movement of said stubs so that the pitch of the blades can be adjusted by such rotational movement of said stubs;

d) a pitch control rod adapted to undergo linear motion, said pitch control rod being angularly disposed relative to said pitch adjusting shaft;

e) means for converting linear motion of said pitch control rod into linear motion of said pitch adjusting shaft;

f) a second rotatable drive shaft, said second rotatable drive shaft being angularly disposed relative to said hollow drive shaft; and g) means for converting rotary motion of said second rotatable drive shaft into rotary motion of said hollow drive shaft to thereby cause rotation of said hub.

Embodiment F: In this embodiment, the apparatus of Embodiment E is included in a stern drive system wherein the prime mover is an outboard motor mountable (and in a still further embodiment, mounted) on the transom of the boat and wherein the second rotatable drive shaft is rotatable by rotational energy supplied by the outboard motor.

Embodiments G and H: These embodiments modify the apparatus of Embodiment E by the inclusion therewith of the following: In G there are included: h) a pitch control shaft adapted to undergo linear motion and angularly disposed relative to said pitch control rod; and i) means for converting linear motion of said pitch control shaft into linear motion of said pitch control rod.

In H) there are included: h) a third rotatable drive shaft angularly disposed relative to said second rotatable drive shaft; i) means for converting rotary motion of said third rotatable drive shaft into rotary motion of said second rotatable drive shaft; and j) means, such as a flexible coupling, permitting the angular disposition between said second rotatable drive shaft and at least a portion of said third rotatable drive shaft to change in the event a force is applied (e.g., a force resulting from encountering or striking a submerged obstacle) tending to change the angular displacement of said second rotatable drive shaft relative to said third rotatable drive shaft.

Embodiment I: This embodiment involves including the apparatus of Embodiment H in a stern drive system wherein the prime mover is an inboard motor mountable (and in a still further embodiment, mounted) within the boat and wherein said third rotatable drive shaft is rotatable by rotational energy supplied thereto by the inboard motor.

Embodiment J: In this embodiment the apparatus of Embodiment E is modified by the inclusion therewith of: h) a pitch control shaft adapted to undergo linear motion and angularly disposed relative to said pitch control rod; i) means for converting linear motion of said pitch control shaft into linear motion of said pitch control rod; j) a third rotatable drive shaft angularly disposed relative to said second rotatable drive shaft; k) means for converting rotary motion of said third rotatable drive shaft into rotary motion of said second rotatable drive shaft; and 1) means, such as a flexible coupling, permitting the angular disposition between said second rotatable drive shaft and at least a portion of said third rotatable drive shaft to change in the event a force is applied (e.g., a force resulting from encountering or striking a submerged obstacle) tending to change the angular displacement of said second rotatable drive shaft relative to said third rotatable drive shaft.

Embodiment K: In this case the apparatus of Embodiment J is employed in a stern drive system wherein the prime mover is an inboard motor mountable (and in a still further embodiment, mounted) within the boat and wherein said third rotatable drive shaft is rotatable by rotational energy supplied thereto by the inboard motor.

Other Embodiments: The apparatus of Embodiments A through K such as for example Embodiments A, B, C and D are preferably constructed such that the axis of the aforesaid pitch control rod is angularly disposed at essentially 90° relative to the axis of the aforesaid pitch adjusting shaft. Similarly, the apparatus of Embodiments E through K such as for example Embodiments E, F, H and J are preferably constructed such that the axis of the aforesaid second rotatable drive shaft is angularly disposed at essentially 90° relative to the axis of the aforesaid hollow drive shaft. Likewise, in each of the foregoing embodiments the aforesaid hub preferably has two of the aforesaid arcuate recesses disposed on opposite sides of the hub, and is equipped with a pair of the aforesaid unitary propeller blades. Note in this connection, FIGS. 25 through 30. Additionally, it is particularly preferred to utilize in each of the embodiments referred to hereinabove commencing with Embodiment A, planar blades having the following additional features, either singly or in combination:

1) A relatively thick or blunt trailing edge portion.
2) Generally flat surfaces between the leading edge portion and the trailing edge portion.
3) A planar configuration which falls entirely along a single flat plane (note for example FIGS. 15, 16, and 25-28), or a planar configuration which falls along a single flat plane from the inner end portion of the blade to a locus between about $\frac{1}{2}$ to about $\frac{3}{4}$ (more preferably about $\frac{2}{3}$) the distance between the inner end portion and the outer end portion, at which locus the planar configuration of the blade becomes progressively bent but not twisted for at least a portion of the remaining distance to the outer end portion of the blade (note for example FIGS. 18, 19, 21 and 22).
4) A leading edge portion that is no more than about 1/32 of an inch in thickness.
5) A trailing edge portion that is in the range of from about $\frac{1}{8}$ to about $\frac{3}{8}$ of an inch (more preferably about $\frac{1}{4}$ inch) in thickness.
6) A facial area in the range of about 6 to about 25, and in many cases in the range of about 6 to about 15, square inches per blade side. In this connection, the higher the horsepower of the prime mover, the larger should be the facial area of the blades.

The above and still other embodiments and features of this invention should be readily apparent from the ensuing description appended claims and accompanying drawings.

THE DRAWINGS

FIG. 17 is an elevational view of the back end of a hub into which are fitted a pair of bent planar blades of preferred configuration pursuant to this invention, these blades being adapted for rotation in the clockwise direction (as viewed in this Figure).

FIG. 18 is a view of the upper blade of FIG. 17 looking in the direction of line 18,18 of FIG. 17.

FIG. 19 is a section of the upper blade of FIG. 17 taken along line 19,19 of FIG. 17.

Figure 23:
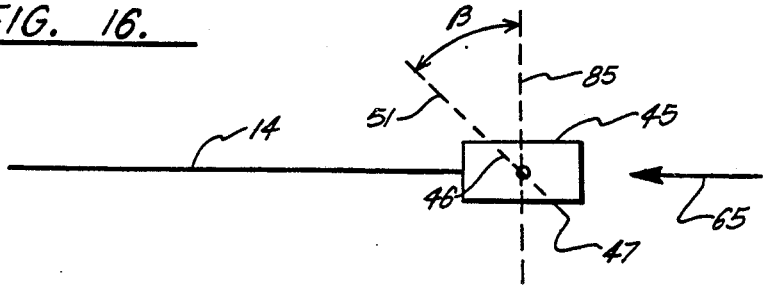

FIG. 23 schematically depicts in plan view the positioning of the planar blades in the fast forward position in a system involving clockwise rotation (as viewed in the direction of the arrow therein).

FIG. 24 schematically depicts in plan view the positioning of the planar blades in a reverse position in a system involving clockwise rotation (as viewed in the direction of the arrow therein).

Figure 25:
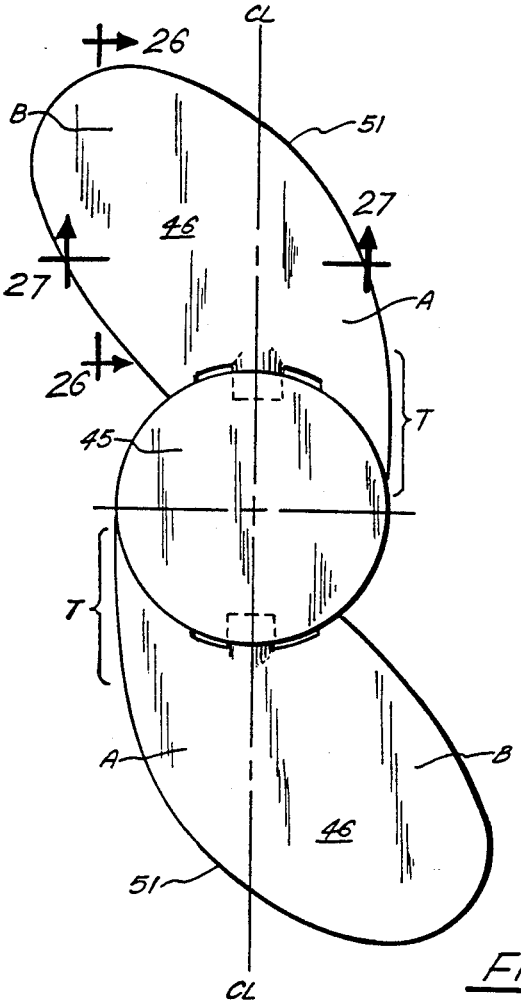

FIG. 25 is an elevational view of the back end of a hub into which are fitted a pair of grooved tangential swept back flat planar blades of particularly preferred configuration pursuant to this invention.

Figure 26:
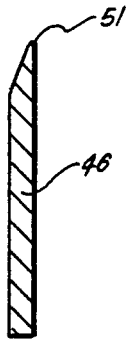

FIG. 26 is a view of the upper blade of FIG. 25 looking in the direction of line 26,26 of FIG. 25.

Figure 27:
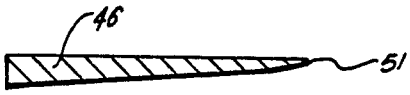

FIG. 27 is a section of the upper blade of FIG. 25 taken along line 27,27 of FIG. 25.

Figure 28:
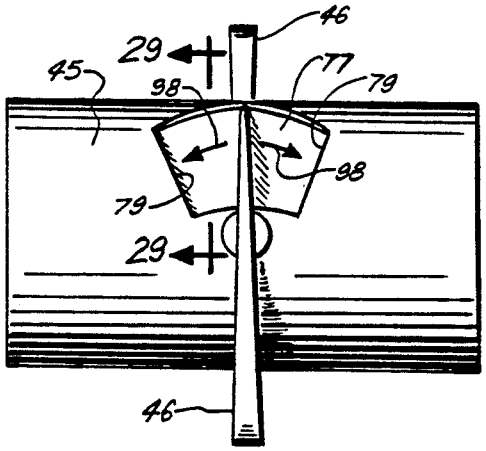

FIG. 28 is a top plan view of the upper blade and the upper portion of the hub of FIG. 25.

Figure 29:
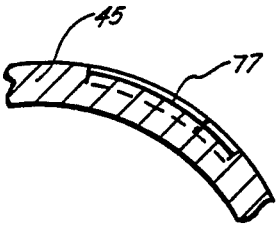

FIG. 29 is a fragmentary section of the hub of FIG. 25 taken along line 29,29 of FIG. 28.

Figure 30:
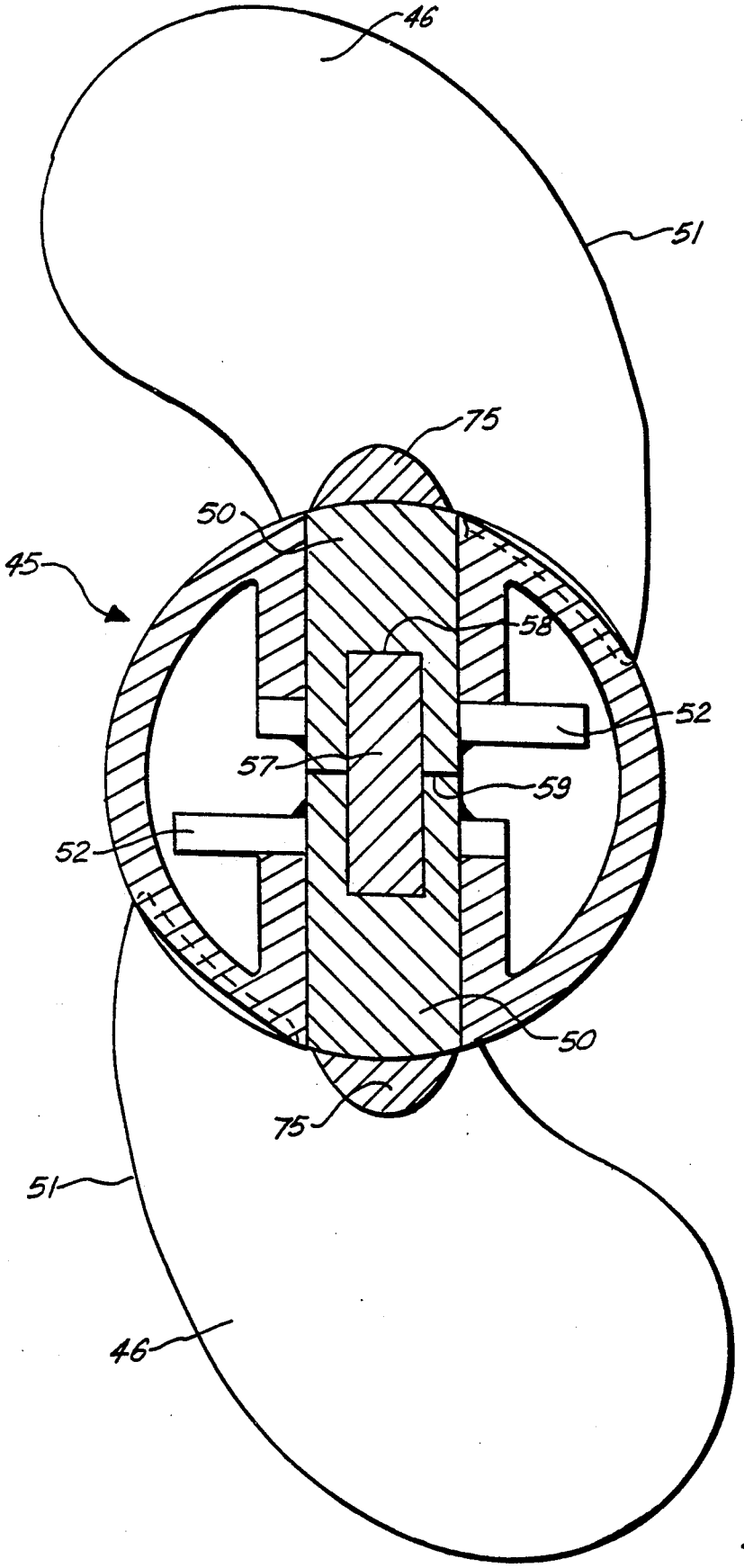

FIG. 30 is an elevational view, partly in section, of a hub and a pair of grooved tangential swept back flat planar blades with a preferred mechanism within the hub for rotating the blades on the axis of their respective stubs.

Figure 31:
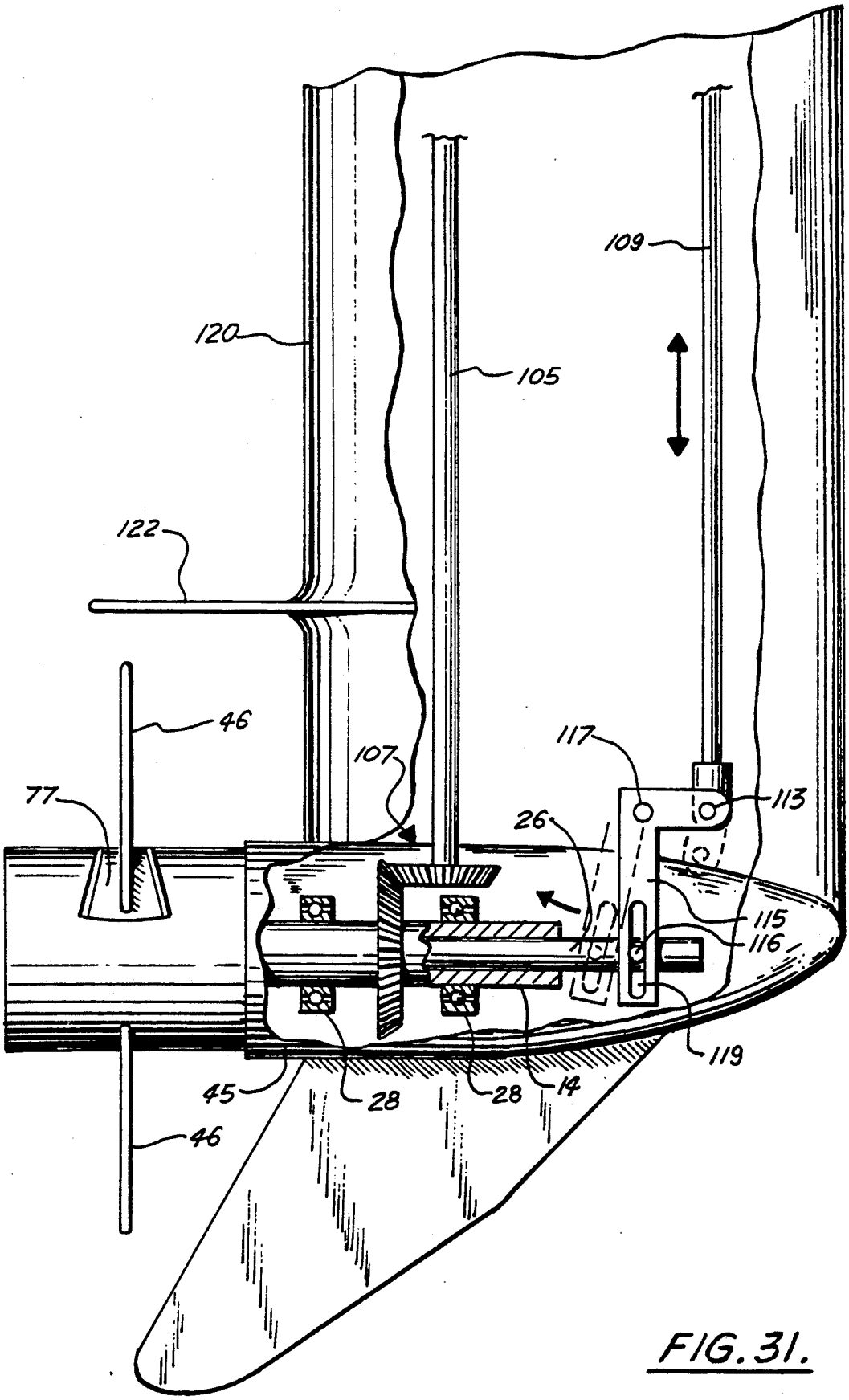

FIG. 31 is a schematic side view of the lower portion of a stern drive system equipped pursuant to this invention with variable pitch blades, a pitch adjusting system, and a drive or propulsion system, all in accordance with preferred embodiments of this invention.

Figure 32:
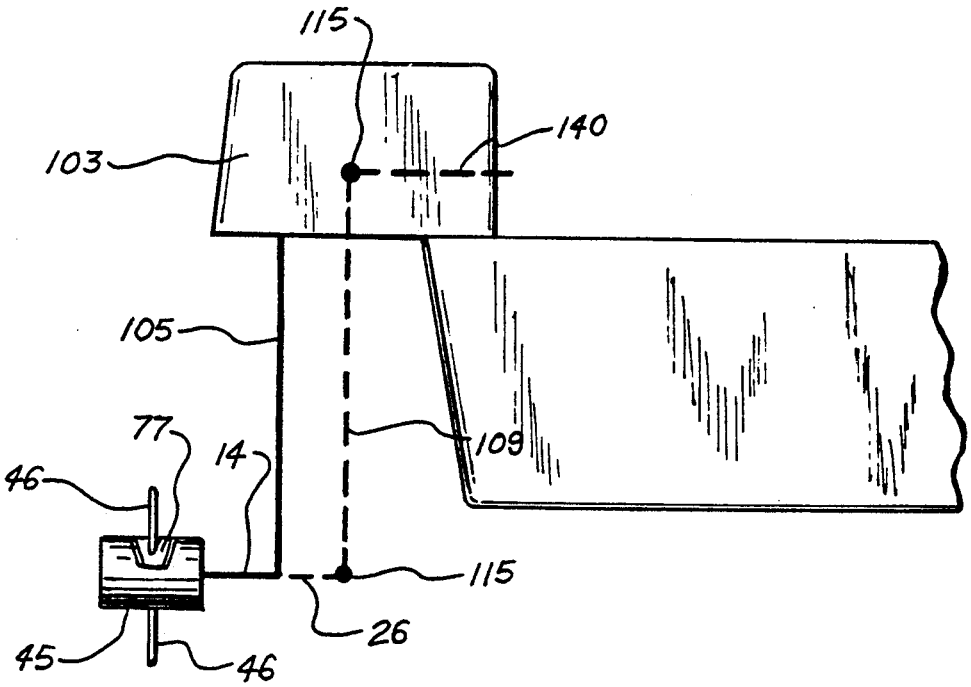

FIG. 32 is a stick diagram schematically illustrating a stern drive system including the portion depicted in FIG. 31 wherein the prime mover is an outboard motor mounted on the transom of a boat.

Figure 33:
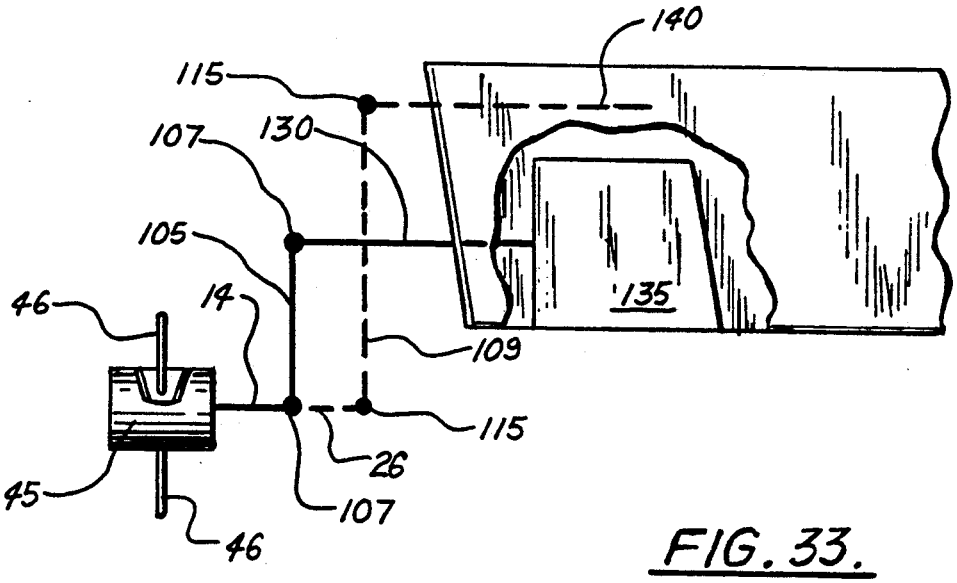

FIG. 33 is a stick diagram schematically illustrating a stern drive system including the portion depicted in FIG. 31 wherein the prime mover is an inboard motor mounted in a boat.

Figure 34:
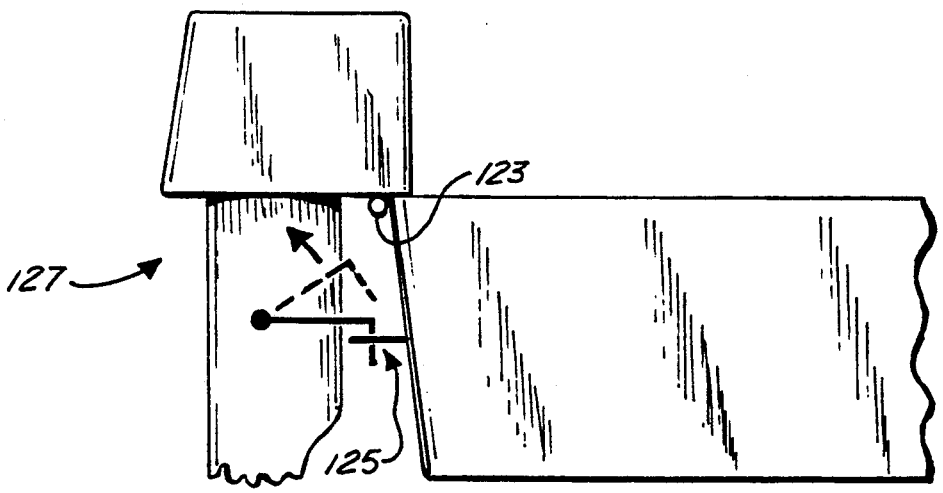

FIG. 34 is a fragmentary schematic depiction of a portion of a stern drive system illustrating the principle of use of a locking mechanism when the pitch of the blades is being adjusted to propel the boat in a reverse direction.

Figure 35:
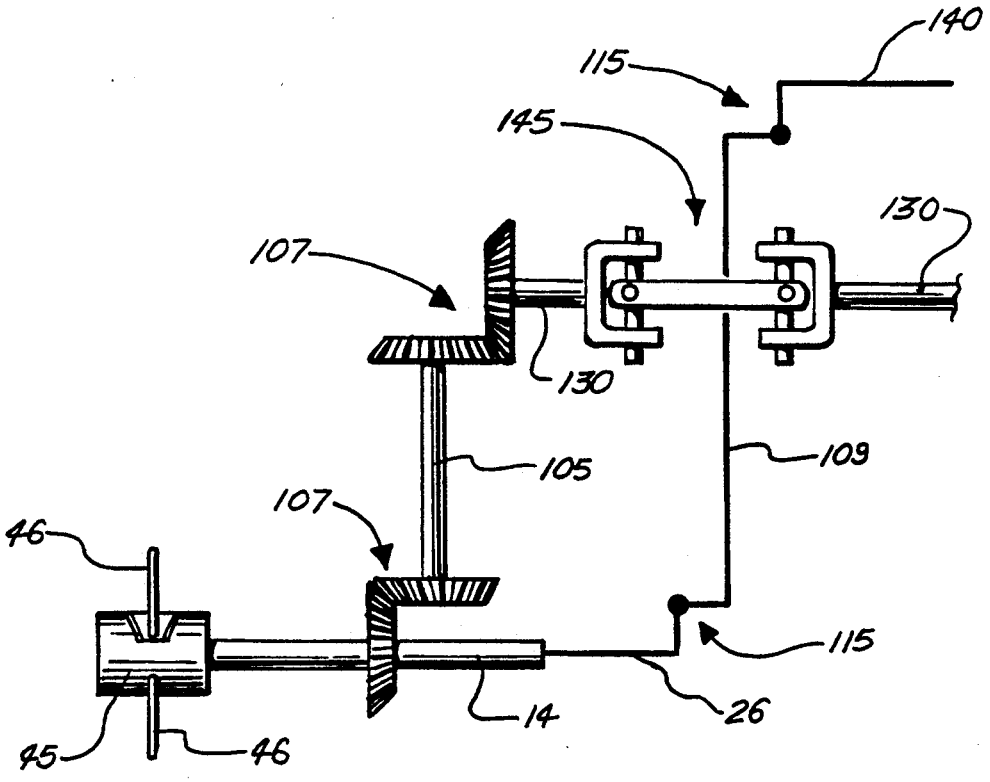

FIG. 35 is a side view of a stern drive system of the type of FIG. 33 illustrating, inter alia, a typical mechanism which can be used for converting rotary motion from one drive shaft to another drive shaft angularly disposed therefrom, and a flexible coupling which permits the angular disposition between a pair of such rotatable drive shafts to change in the event a force is applied (e.g., a force resulting from encountering or striking a submerged obstacle) tending to change the angular displacement of between such drive shafts.

DESCRIPTION OF PREFERRED EMBODIMENTS

In order to still further illustrate the practice and advantages of this invention reference is now made to the Drawings in which like numerals represent like parts among the several views. The Drawings, which are not to scale, depict and illustrate only certain preferred forms of the invention. Other forms of the invention and apparatus provided thereby will be readily apparent from a consideration of this entire disclosure.

The Planar Blades of the Invention

Figure 15:
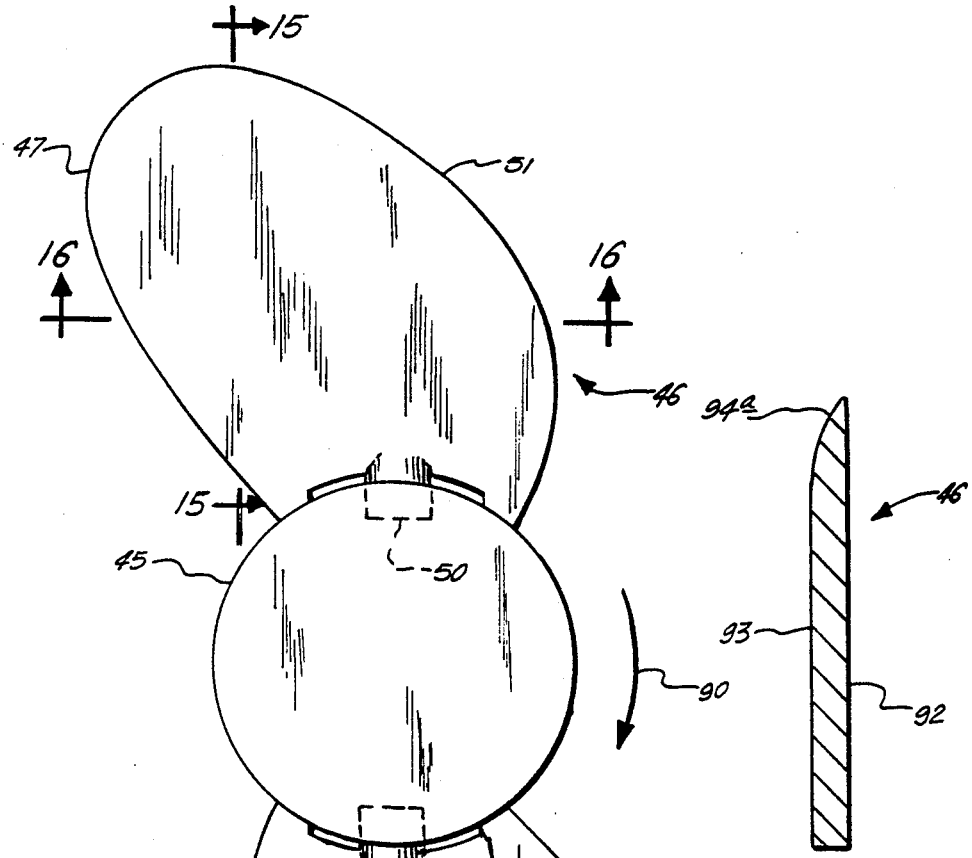
FIG. 15 is a view of the upper blade of FIG. 14 looking in the direction of line 15,15 of FIG. 14.
Figure 14:
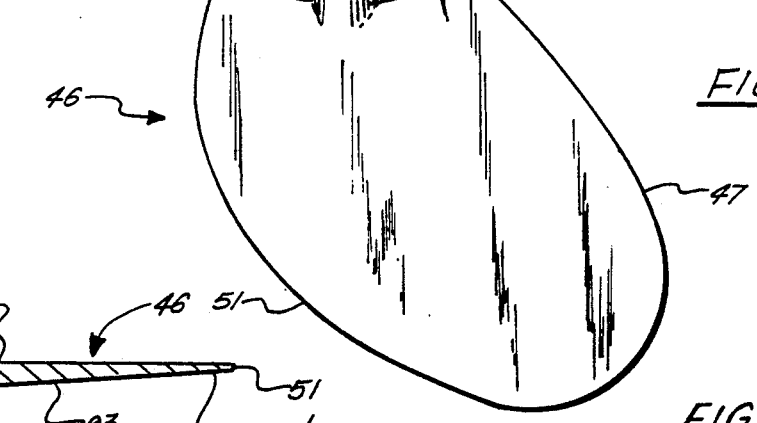
FIG. 14 is an elevational view of the back end of a hub into which are fitted a pair of flat planar blades of preferred configuration pursuant to this invention.
Figure 16:
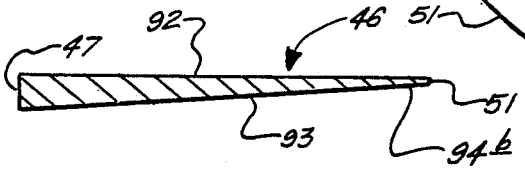
FIG. 16 is a section of the upper blade of FIG. 14 taken along line 16,16 of FIG. 14.

Turning first to FIGS. 14 through 16, the flat planar blades 46 of this invention in the form therein depicted have a relatively sharp leading edge 51 and a relatively thick or blunt trailing edge 47. Each blade is affixed at its inner end as by welding or the like to a cylindrical stub 50 which is adapted to be axially rotated by adjusting means, preferably of the type described hereinafter. Such rotation allows the pitch of the blades to be adjusted. Hollow hub 45 contains some of the mechanism (not shown in FIGS. 14–16, but a preferred form of which is described hereinafter in connection with FIGS. 10, 11 and 30) for effecting such axial rotation. In the system as depicted in FIGS. 14–16, hub 45, and each blade 46 and its stub 50, are rotated in the direction of arrow 90 by a drive shaft and drive train (not shown in FIGS. 14–16, but a preferred form of which is described hereinafter in connection with FIGS. 3–11) so that leading edge 51 cuts into the water. It is to be understood that if the rotation by the drive shaft and drive train is arranged to be in the counter-clockwise direction (opposite to the clockwise direction of arrow 90) then each of the flat planar blades 46 of FIG. 14 would be rotated 180° on the axis of its stub 50 so that the positions of the leading edge 51 and the trailing edge 47 would be the reverse of the positions shown. The swept back configuration of leading edge 51 as depicted in FIG. 14 should be noted. Of this, more will be said hereinafter.

FIG. 15 illustrates the fact that in their most preferred form the respective faces 92 and 93 of flat planar blades 46 are essentially completely flat from inner end to outer end with only a small degree of curvature or taper or thinning out as at 94*a* near the outer end. FIGS. 15 and 16 illustrate the fact that in their most preferred form the respective faces 92 and 93 of flat planar blades 46 are likewise essentially completely flat from leading edge 51 to trailing edge 47, but that the thickness of the blade is more or less progressively increased from thin edge 51 to thick edge 47. The forward edge portion of the blade may additionally be sharpened or thinned out even more near the leading edge 51 as at 94*b*. Trailing edge 47 may be squared off (as shown) or it may be rounded off so that there are no relatively sharp corners. Likewise it may be tapered down in thickness. In short, the thicker portion of the blade is either at the trailing edge of the blade or is somewhere between about the median portion of the blade and its trailing edge. The presence of the thicker portion of the blade is to insure that the blade has sufficient strength to apply the necessary force against the water to propel the boat. For best results face 92—the face away from the rear of the boat—should be flat and any taper or the like should be in face 93 (such as is depicted in FIGS. 15 and 16). The blade may be be thin and completely uniform in cross section (e.g., 1/32 inch) if made from a material having sufficient strength to propel the boat without becoming distorted or undergoing physical deterioration (fatigue) after prolonged usage.

FIGS. 17 through 19 depict in a preferred configuration bent planar blades 46*a*. It can readily be seen that these bent planar blades can possess all of the structural features as the flat planar blades just described, but differ therefrom in that they possess a progressive bend along their outermost portions. This bend preferably commences at a locus 95 which is between about ½ to about ¾ (most preferably about ⅔) the distance from the inner end and the outer end of the blade. The blades depicted in these Figures are adapted for use in propulsion systems in which the propeller shaft and hub 45 rotate clockwise (when viewed from a location behind the boat and propeller) in the direction of arrow 97. Thus in this case the relatively thin leading edge 51 of the upper blade in FIG. 17 (the blade in the 12 o'clock position) is on the right hand side of FIG. 17, since this is the direction toward which the blade is rotated by rotation of the propeller shaft. When this same blade is rotated to the 6 o'clock position (the position of the lower blade in FIG. 17), its leading edge will of course be toward the left hand side of that Figure. As FIG. 18 indicates, the bend of planar blades 46*a*,46*a* is toward the front of the boat (i.e., toward the direction in which the boat normally travels). It will be seen that both blades 46*a*,46*a* are of the same geometrical and structural configuration—they are interchangeable with each other. Therefore, for systems in which the rotation is clockwise, only one type of blade—a blade preferably configured as blade 46a in FIGS. 17-19—need be manufactured and maintained in inventory, and moreover in the event one blade is damaged it can be replaced without need for relacing the entire propeller assembly as is often the case. Nevertheless, to insure optimum performance it may be desired to substitute a matched pair of new replacement blades in the event one of the blades in the system becomes damaged.

Once again the swept back configuration of leading edge 51 as depicted in this case in FIG. 17 should be noted. Of this, more will be said hereinafter.

Figures 20, 21, 22:
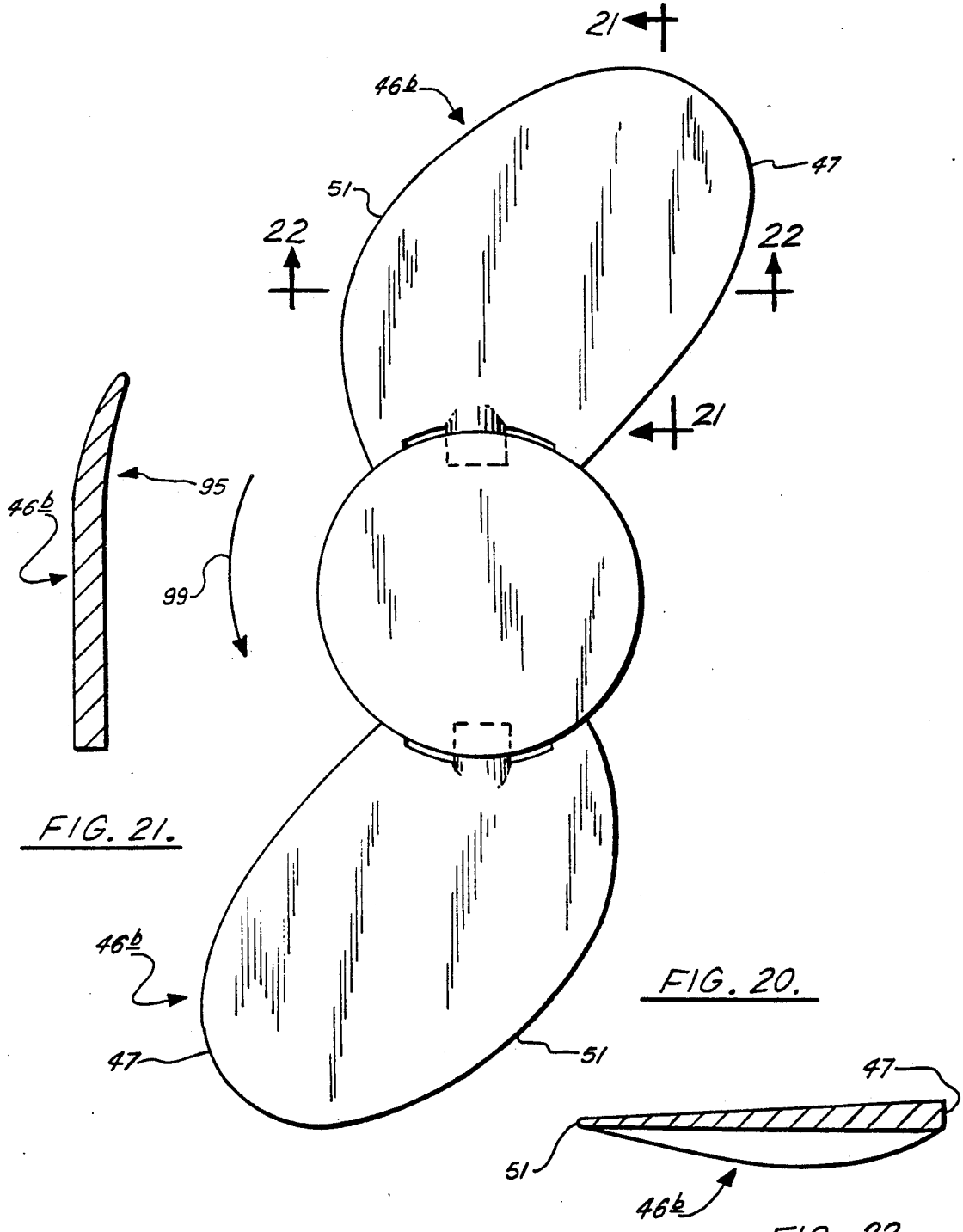
FIG. 20 is an elevational view of the back end of a hub into which are fitted a pair of bent planar blades of preferred configuration pursuant to this invention, these blades being adapted for rotation in the counter-clockwise direction (as viewed in this Figure).
FIG. 21 is a view of the upper blade of FIG. 20 looking in the direction of line 21,21 of FIG. 20.
FIG. 22 is a section of the upper blade of FIG. 20 taken along line 22,22 of FIG. 20.

FIGS. 20 through 22 depict in a preferred configuration bent planar blades 4b. It can readily be seen that these bent planar blades possess all of the structural features as the bent planar blades 46a just described, but differ therefrom in that the positions of the leading edge 51 and the trailing edge 47 are reversed relative to the progressive bend along their outermost portions. As in the embodiment depicted in FIGS. 17-19, this bend preferably commences at a locus 95 which is between about ½ to about ¾ (most preferably about ⅔) the distance from the inner end and the outer end of the blade. However the blades depicted in FIGS. 20-22 are adapted for use in propulsion systems in which the propeller shaft and hub 45 rotate counter-clockwise (when viewed from a location behind the boat and propeller) in the direction of arrow 99. Thus in this case the relatively thin leading edge 51 of the upper blade in FIG. 20 (the blade in the 12 o'clock position) is on the left hand side of FIG. 20, since this is the direction toward which the blade is rotated by rotation of the propeller shaft. When this same blade is rotated to the 6 o'clock position (the position of the lower blade in FIG. 20), its leading edge will of course be toward the right hand side of that Figure. As FIG. 21 indicates, the bend of planar blades 46b,46b is toward the front of the boat (i.e., toward the direction in which the boat normally travels). It will be seen that both blades 46b,46b are of the same geometrical and structural configuration—they are interchangeable with each other. Therefore, for systems in which the rotation is counter-clockwise, only one type of blade—a blade preferably configured as blade 46b in FIGS. 20-22—need be manufactured and maintained in inventory, and moreover in the event one blade is damaged it can be replaced without need for relacing the entire propeller assembly as is often the case. Here again, to insure optimum performance it may be desired to substitute a matched pair of new replacement blades in the event one of the blades in the system becomes damaged.

FIGS. 14, 17, and 20 illustrate a very important feature of the planar blades of this invention, namely that the leading edge 51 is swept back or retracted for a substantial portion of its length (preferably more than 50% of the distance from inner end to outermost end). This permits the blade to slice through the medium in which it being rotated and thus a substantial portion of the leading edge does not confront the medium head-on or tend to force the medium inwardly toward the hub, but rather a substantial portion of the leading edge tends to force the medium outwardly away from the hub. This may explain why such blades are able to cut through wet mud and vegetation under conditions where a helically-twisted or even a paddle-shaped or rectangularly-shaped blade could not operate. Whatever the mechanism or explanation, this feature has been found in actual practice to greatly reduce the incidence of boats becoming mired and bogged down when operating in wet mud or in thickly overgrown marshy areas.

FIGS. 23 and 24 schematically illustrate how the pitch of the planar blades 46 (whether they are flat planar blades 46 or bent planar blades 46a or 46b) can be adjusted for forward and rearward travel, respectively. In these Figures the drive shaft 14 (shown for simplicity as a line) and hub 45 are caused to rotate in a clockwise direction when viewed in the direction of arrow 65 (i.e., viewed from a location behind the boat and propeller, and looking toward the direction in which the boat normally travels). The leading edge 51 of blade 46 (shown for simplicity as a line) is thus toward the top of these Figures since these Figures are plan views with the viewer of course looking down at the system depicted. In FIG. 23 planar blade 46 is in a fast forward position with angle beta being as much as 45°. In FIG. 24 planar blade 46 is in a reverse position with angle gamma being as much as 45°, but preferably no more than about 25°. When blade 46 is axially rotated so that its plane coincides with transverse plane 85 (i.e., angle beta in FIG. 23 and angle gamma in FIG. 24 is 0°), the blades are in their neutral position and the boat is neither driven forward or in reverse. The preferred system of this invention enables these changes in blade pitch to be made quickly, easily and safely through a continuum of positions ranging from fast forward (FIG. 23) to reverse (FIG. 24). Thus flat bottom boats even when operated in thickly vegetated, muddy marshes can now be maneuvered so that they do not become stuck or mired. Persons in south Louisiana having first-hand familiarity with the problems that can be encountered in such operation have expressed, often spontaneously, and occasionally in less than polite language, their utter amazement at the handling characteristics and maneuverability and performance of a flat bottom boat equipped with a preferred system of this invention utilizing a pair of flat planar blades 46 and a mere 18 hp gasoline engine as the power source A most preferred planar blade construction pursuant to this invention is illustrated in FIGS. 25 through 29 to which attention is now invited. Depicted in these figures are the grooved tangential swept back flat planar blades of this invention. It can be seen that in this configuration the blades possess the swept back (retracted) leading edge feature and otherwise resemble the blades of FIGS. 14-22 described above except that the inner portion of leading edge 51 projects substantially tangentially from hub 45 for part of the distance from inner end toward the outer end (i.e., along segment "T") when the blades are in or close to their neutral position (depicted in FIG. 28) where the blade is transverse or substantially transverse to the axis of the drive shaft (not depicted in FIGS. 25-29) and of hub 45. In addition, the inner end of the leading edge portion fits into an arcuate groove 77 shaped to permit and accommodate rotation of the blade in either direction from neutral (as depicted by arrows 98 in FIG. 28). To facilitate an understanding of this grooved construction, arcuate groove 77 is depicted in plan in FIG. 28 as if the groove is in a flat planar surface rather than being cut into the surface of a cylindrical surface of hub 45, which in fact it is. The distortion of arcuate groove 77 when viewed in a plan view as it actually exists in the cylindrical surface of hub 45 might tend to be somewhat confusing, hence the simplification for the sake of better communicating the concepts involved in the actual construction. In this same connection, it will be appreciated that another such groove would be provided for each blade carried by the hub, in this case one additional groove (not shown) for the blade extending from the opposite side of hub 45.

The respective ends 79 of groove 77 serve as stops to prevent over-rotation of the blade in either such direction. As can be appreciated (and as indicated in FIG. 29) groove 77 becomes deeper when proceeding in the direction of midpoint (i.e., transverse to the axis of hub 45) to the respective ends 79,79. The planar blades of this invention which include these tangential and grooved configurations possess all of the advantageous features of the blades of FIGS. 14–22, but additionally have the advantage that vegetation and other debris rarely if ever become entangled with the blades or wedged between the blades and hub. As a consequence, these particularly preferred blades enable operation in swamps with an efficiency which, to the best of our knowledge and belief, has never been achieved heretofore with any other propeller design, drive system and engine of equal horsepower.

As will be appreciated by those skilled in the art, the amount of surface area of the blades used should not require driving power in excess of the power available from the engine or other prime mover being used to supply the power needed to propel the boat under the service conditions to be encountered. If, in other words, the blades are too large to be effectively driven through the water or wet mud or vegetation-rich swamp by a given engine, one should either use smaller blades of the same configuration or a more powerful engine, or both, so that the prime mover has the capacity to effectively propel the boat under the service conditions to be encountered. On the other hand, the surface area of the blades should be large enough to take advantage and make effective use of the power available from the engine being used. The relationship between blade surface area and engine horsepower to achieve best performance will depend on various factors such as the size and shape of the boat hull, the number of blades being used, the load to be carried in the boat, the frictional characteristics of the drive train, the density of the wet mud and foliage in which the boat may be operated, and so on. The following relationships, which are presented for purposes of illustration and not limitation, should be of help in designing or selecting components for a two-bladed propeller and drive and pitch-adjusting system of the type described herein:

| Engine Horsepower | Approximate Number of Square Inches of Surface Area for One Face of One Planar Blade |
|---|---|
| 12–14 | About 6 to about 7 |
| 18 | About 8 to about 9 |
| 25 | About 10 to about 11 |

It will be seen that, generally speaking, the higher the horsepower, the larger the blade surface area. Thus with a 50 hp engine the most suitable blade surface area will be larger than about 11 square inches, and with 100 hp engines it will be larger still.

Referring again to FIGS. 25 to 29, another surprising feature of these particular blades is that when the surface area is adjusted as indicated in the above table and this surface area is properly apportioned between the areas fore and aft of centerline CL in FIG. 25 the best overall performance can be achieved. For example, with an 18 hp engine, a variable pitch control and drive system of the type described hereinafter, and with a pair of variable pitch grooved tangential swept back flat planar blades of the type depicted in FIG. 25 in which the ratio between area "A" to the foreward side of centerline CL and area "B" to the rearward side of centerline CL is about 45:55, there is no tendency for control lever 11 of the system described hereinafter (see FIGS. 1 and 2) to move in either direction even when not held in any given position by the operator. However the maximum boat speed is not obtainable from this particular system under these particular circumstances. When the same type of blade is slightly modified such that the ratio between area "A" to the foreward side of centerline CL and area "B" to the rearward side of centerline CL is about 42:58 again there is no tendency for control lever 11 to move in either direction even when not held in any given position by the operator, and in this particular case the boat can be operated smoothly at all speeds, including high speeds. When under these same conditions this same ratio is adjusted to about 40:60 very similar results are achieved except that there is a slight tendency for control lever 11 to move when not held in position by the operator, but only at the highest speeds of boat operation. And when under these same conditions this same ratio is adjusted to about 38:62, very high speed boat operation can be achieved but in this particular case and under these particular conditions there is a sufficient tendency for control lever 11 to move when not held in position by the operator that it is desirable to provide means for holding lever 11 in whatever position it is moved into by the operator. Each of the foregoing situations provides acceptable operation pursuant to this invention. Thus the selection of any given ratio as between area "A" and area "B" will depend on the type of operation and service sought to be designed into any given system. If speed is of paramount importance, a ratio such as 38:62 may be selected and means provided to lock lever 11 in whatever position the operator may select. On the other hand, if a system in which lever 11 is unrestrained and automatically stays where placed by the operator, but high speed operation is not an objective, a ratio of about 45:55 may be selected. An ideal compromise in order to achieve both high speed and unrestrained operation of lever 11 would involve use of a ratio of about 42:58. The foregoing relationships among engine horsepower, blade configuration, blade size and blade area distribution, which are presented for purposes of illustration and not limitation, should be of further help in designing or selecting components for a two-bladed propeller and drive and pitch-adjusting system of the type described herein.

Variable Pitch Adjusting System and Drive Mechanism

At the outset it is to be understood and appreciated that the blades of this invention can be effectively used with any suitable drive and pitch-adjusting system, such as those described in same of the patents cited hereinabove. However for best results a system of the type described hereinafter should be used, and the combination of the blades of this invention and a system of the type described hereinafter constitutes an especially preferred embodiment of this invention.

Figure 3:
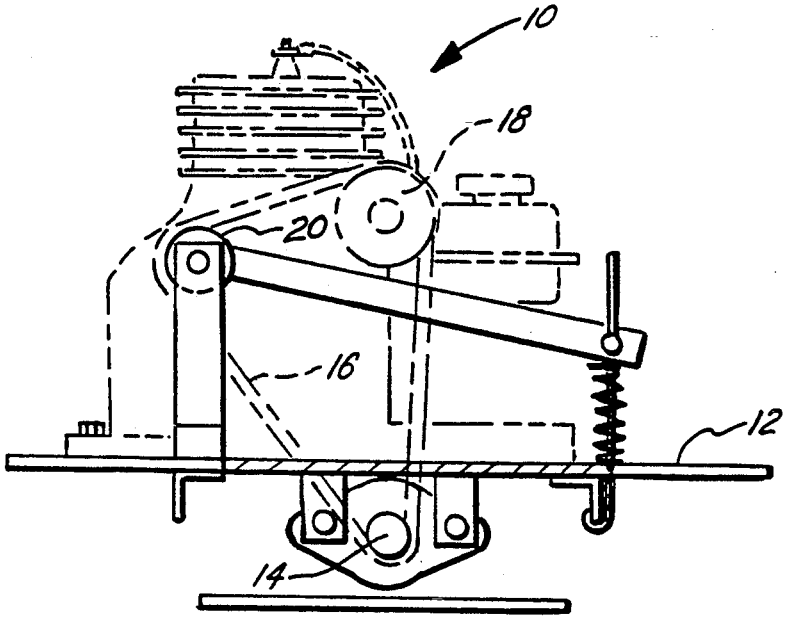
FIG. 3 is a section, partly in phantom, taken along line 3,3 of FIG. 1.

The preferred form of variable pitch and adjusting mechanism and drive system for use with the planar blades of this invention, in its preferred form depicted, is especially adapted for use with flat bottom mud boats utilizing a relatively small engine (e.g., up to about 25 hp) as the prime mover 10 (note FIG. 3). Platform 12 is disposed above the inner end portion of hollow drive shaft 14, and serves as a means for mounting prime mover 10 on the upper portion of the mechanism to conserve space within the boat (not shown). As best seen in FIG. 3, an endless belt 16 driven by pulley 18 passes over and rotates drive shaft 14. A pulley (not shown) may be affixed to drive shaft 14 to accommodate belt 16, if desired. Rotatable belt tensioner 20 is adjustably secured in position to enable the tension on belt 16 to be properly adjusted. Thus operation of prime mover 10 causes rotation of drive shaft 14 by means of belt 16.

Drive shaft 14 is rotatably secured along a portion of its length within shaft housing 22 by means of bearings (not shown). Drive shaft 14 is hollow along its length (note FIG. 6) and in the form depicted is affixed at its outer end to open-ended hollow housing 24 which is rotatable therewith. Mounted within drive shaft 14 is pitch adjusting rod or shaft 26 which is longitudinally slidable within bearings or bushings 28 secured within drive shaft 14. Shaft 26 and bearings or bushings 28 rotate in unison with drive shaft 14 and housing 24. Hub end cap 30 is adapted to be detachably secured to housing 24 by means of threaded studs 32 (which pass through matching apertures 34) and exteriorly affixed nuts 36. A pair of split bushings 38 are mounted and affixed (for example by welding) in matching recesses 40 on opposite sides of the outer end of housing 24, and a matching pair of split bushings 42 are mounted and similarly affixed in matching recesses 44 on opposite sides of the inner end of end cap 30. Thus when end cap 30 is secured to housing 24 there is formed a hollow hub 45 together with a pair of bearings formed from the respective opposed pairs of stationary split bushings 38,42. As seen from FIGS. 1 and 2, planar blades 46 are carried by hub 45.

Figure 10:
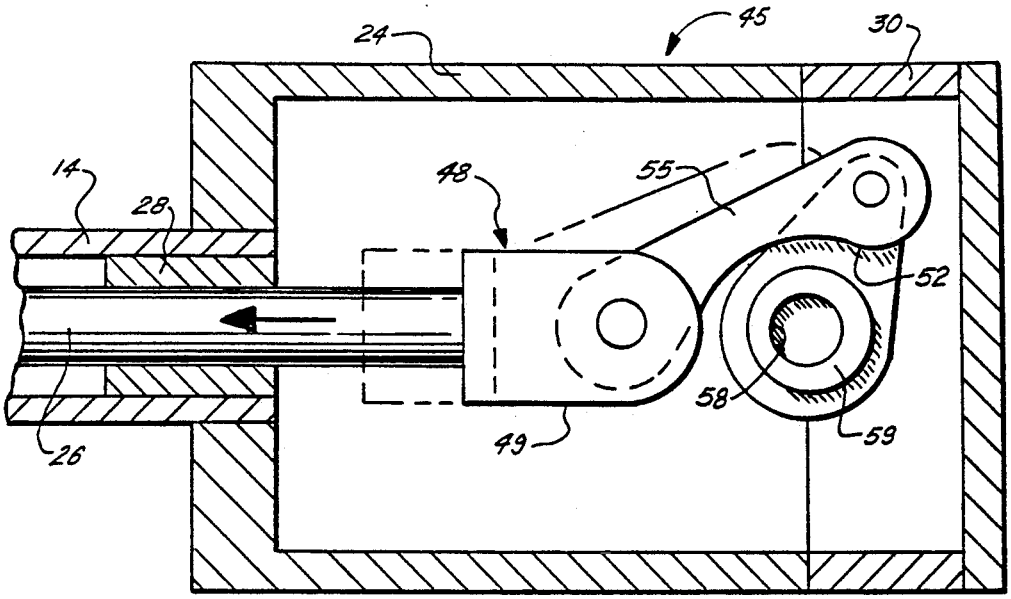
FIG. 10 is a side view, partly in section, of a hub with means therein for translating longitudinal movement of the pitch adjusting shaft into rotational movement for adjusting the pitch of the blades.
Figure 11:
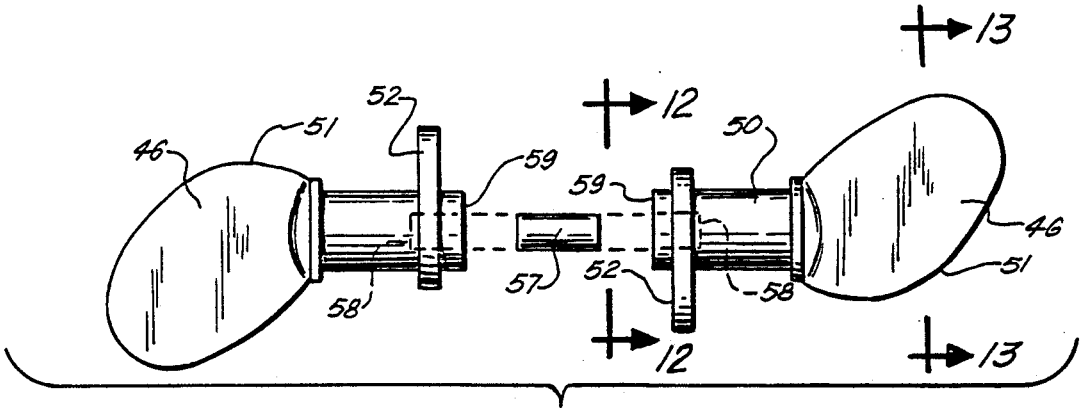
FIG. 11 is a transverse exploded view of a pair of propeller blades each with a cylindrical stub and a lobe utilized, inter alia, for translating longitudinal movement of the pitch adjusting shaft into rotational movement for adjusting the pitch of the blades.

Within hub 45 is contained means for translating longitudinal movement of shaft 26 into rotational movement of blades 46 around their own axes in order to change the pitch of the blades. Secured to the outer end portion of shaft 26 is yoke 48 comprising a pair of laterally spaced, axially projecting ear portions 49. Secured to the interior portion of each blade 46 is a cylindrical stub 50 having a lobe portion 52 integral therewith. As can be seen from FIGS. 10, 11 and 12, the lobe portions 52 extend radially along an axis perpendicular to the axis of stub 50 and thereby form a crank thereon. As shown by FIG. 11, the two lobe portions 52 extend in generally opposite directions, one extending generally upwardly and the other generally downwardly. A link 55 is pivotally mounted on and connects each of the repective lobe portions 52 to the transversely proximate ear portion 49 of yoke 48. Thus as viewed in FIG. 10 one of the links 55 is connected between the transversely remote ear portion 49 and the transversely remote lobe portion 52. It will be understood and appreciated therefore that the same linkage applies to the transversely proximate ear portion 49 and the transversely proximate lobe portion 52 (not shown in the sectional view of FIG. 10) nearer the viewer, except that the positions of this proximate link 55 and this proximate lobe portion 52 will be inverted as compared to those depicted in FIG. 10. Thus as indicated for example in FIGS. 10 and 12, longitudinal movement of shaft 26 causes rotation of the respective lobe portions 52 in opposite directions which in turn causes the respective stubs 50 and planar blades 46 to rotate around their axes in opposite directions so that the pitch of the planar blades can thereby be adjusted within a continuum of positions.

FIG. 30 depicts a hub 45 containing means as described above for translating longitudinal movement of shaft 26 into rotational movement of blades 46 around the axis of their respective stubs 50 in order to change the pitch of the blades. In FIG. 30 the blades are a pair of grooved tangential swept back planar blades of the type described hereinabove. The blades are attached to their respective stubs 51 by means of a ground weld as at 75.

A feature of this invention is illustrated in FIGS. 11 and 30, viz., the particularly preferred way in which the blade stubs 50 axially abut and rotatably engage each other. As depicted in FIGS. 11 and 30, the inner end of each stub 50 has an axially positioned cylindrical recess 58 thereby forming an annular face 59 on the end of each stub. The recesses are sized and shaped to slidably receive dowel 57 to keep both stubs in axial alignment. In addition, the opposed faces 59,59 abut each other around dowel 57. This construction provides a large area of slidable contact between the respective stubs and as explained hereinabove, it is believed that this coupling of opposed torsion derived forces imposed on the blades 46 as they are rotated in the water around the axis of shaft 14 tends to pit these counter-rotational forces against each other so that the selected pitch of the blades resists change caused by such forces except in extenuating circumstances such as a blade striking a heavy submerged object. In this same connection, FIG. 10 illustrates that while a longitudinal force imposed on shaft 26 will cause rotation of stub 50 and a change in the pitch of propeller blade 46, undesired longitudinal movement of shaft 26 tends to be resisted by the frictional contact between shaft 26 and bushing 28. Further, since the entire unit depicted in FIG. 10 is rotating around the axis of shaft 26, it is believed that centrifugal forces generated in such rotation tend to provide resistance against undersired longitudinal movement of shaft 26. It is to be understood and appreciated, however, that this invention is not intended to be limited, nor should it be limited, to any theory of operation. The invention has been found to work, and to work very well under actual service conditions, irrespective of the theoretical niceties of why it works.

Another important advantage of the construction depicted in FIG. 11 is the fact that both blade-stub assemblies are identical to each other, both in size and shape and weight. Thus if one planar blade is damaged during use, it can be replaced by another identical blade-stub assembly—there is no need to stock two differently constructed blade-stub assemblies. Moreover the fact that the two halves of the blade-stub assemblies are the same (except disposed in inverted positions relative to each other, as depicted) insures that the entire system is well balanced and provide smooth operation. In this connection, it is desirable in the case of stainless steel blades to match the weight of the respective blade-stub assemblies to within about ½ of an ounce.

Figure 13:
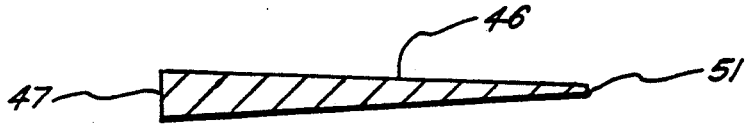
FIG. 13 is a transverse cross-section of a blade having a generally flat outer surface and one relatively thick edge and one relatively thin edge, the view taken along line 13,13 of FIG. 11.
Figure 5:
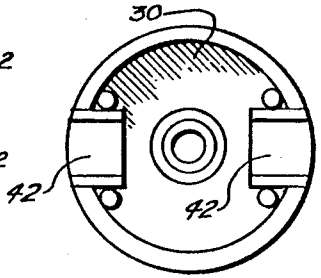
FIG. 5 is a front view of the inside of a hub end cap detachably securable to the hollow housing of FIG. 4.
Figure 4:
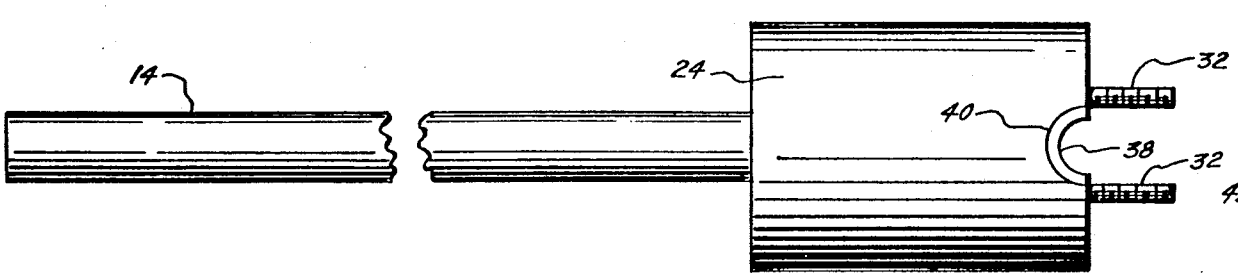
FIG. 4 is a side view of the hollow drive shaft with an open-ended hollow housing affixed thereto.
Figure 6:
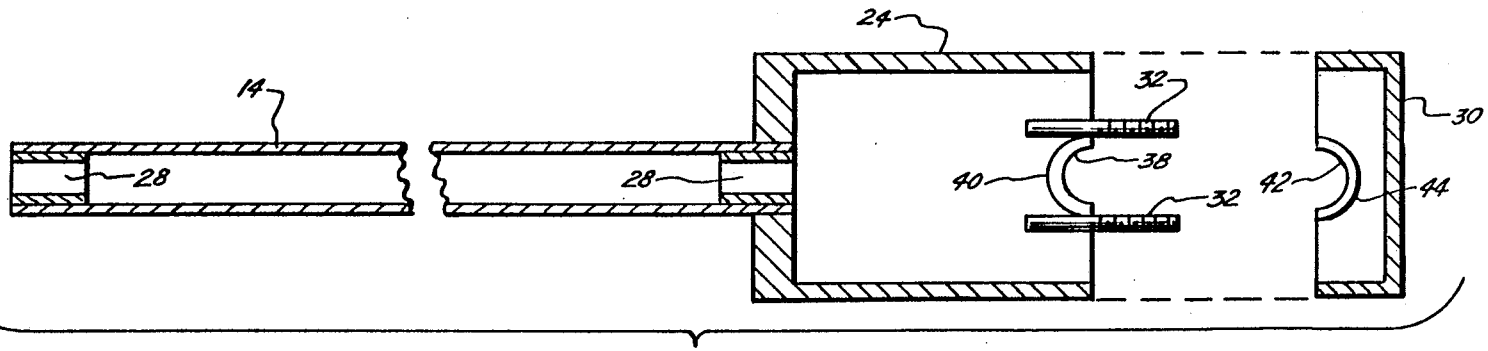
FIG. 6 is an exploded side view in vertical section of the drive shaft and the hollow housing of FIG. 4 together with the hub end cap of FIG. 5.
Figure 9:
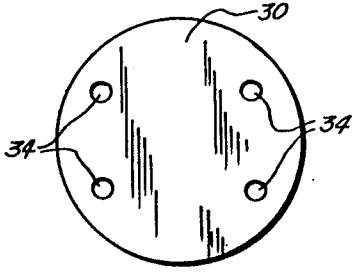
FIG. 9 is a back view of the outside of the hub end cap of FIG. 5.
Figure 7:
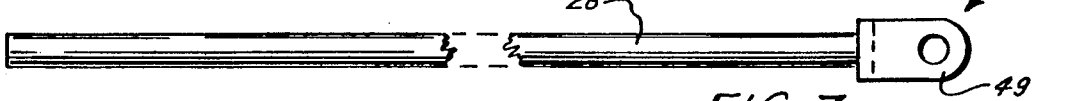
FIG. 7 is a side view of a pitch adjusting shaft longitudinally slidable in bushings disposed in the drive shaft of FIGS. 4 and 6.
Figure 8:
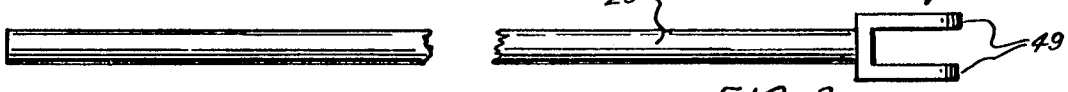
FIG. 8 is a top view of the pitch adjusting shaft of FIG. 7.
Figure 12:
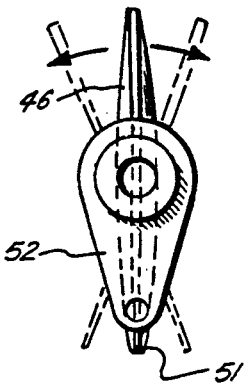
FIG. 12 is an end view taken along line 12,12 of FIG. 11 and showing, inter alia, a generally planar blade having convex outer transverse surface.

FIGS. 12 and 13 illustrate respective features of the planar blades. In one form the blades preferably have in transverse profile a convex shape as indicated in FIG. 12 whereas in other preferred forms they have a substantially flat transverse profile as indicated in FIG. 13. FIG. 13 illustrates still another preferred feature, namely that the blades, whether of a convex or flat generally planar profile, can have one relatively thick edge 47 and in any event do have one relatively thin edge 51, the latter serving as the leading edge. This feature has been found particularly desirable in mechanisms used in propelling mud boats in swampy or marshy areas. For example, with a pair of blades each having on one side a facial area of about ten square inches, one edge (the trailing edge) preferably has a thickness in the range of about ⅛ to about ⅜ inch, most preferably about ¼ inch, whereas the other edge (the leading edge) should be sharp or relatively sharp, e.g., it is preferably no more than about 1/32 inch in thickness.

Figure 1:
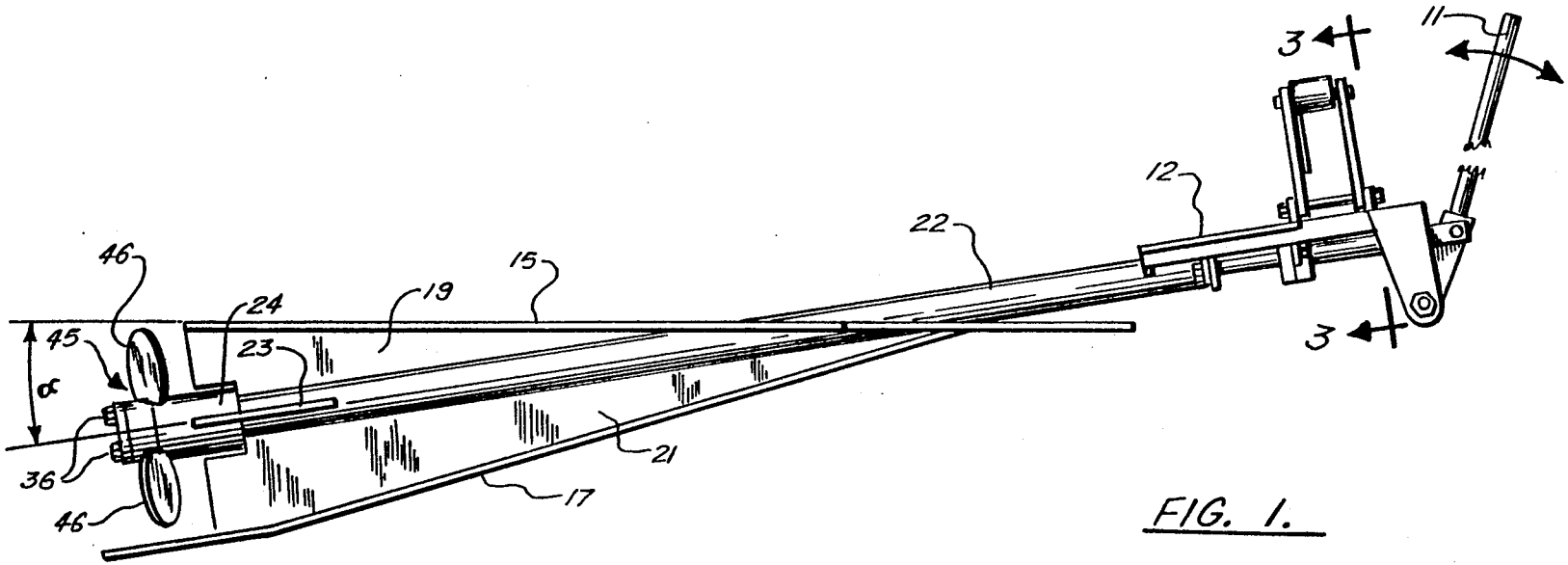
FIG. 1 is a side view of a preferred mechanism of this invention.
Figure 2:
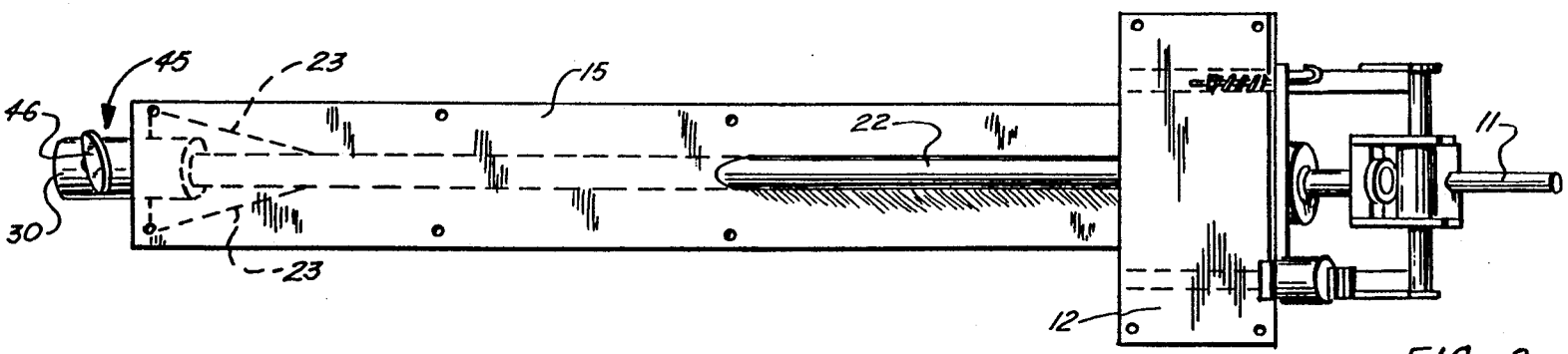
FIG. 2 is a top view, partly in phantom, of the mechanism of FIG. 1.

As depicted in FIGS. 1 and 2 control lever 11 is pivotally connected to the mechanism so that forward or rearward movement of the lever as indicated by the arrows in FIG. 1 causes longitudinal movement of shaft 26 and consequent adjustment in the pitch of the blades. As noted hereinabove, lever 11 need not be equipped with stops for specified intermediate positions, although such stops may be provided, if desired. It is however desirable to provide stops to confine the limits of forward and reverse travel of lever 11 so that the engine or other prime mover is not subjected to excessive speeds or stress during operation. In the system of FIGS. 25–30 the ends 79,79 of groove 77 can serve as stops.

FIG. 1 also illustrates the fact that for flat bottom boat operation the mechanism is preferably mounted on the boat so that its angle of rearward decline (angle alpha) from the horizontal is between about 10 and about 12 degrees, most preferably about 10 degrees.

Other preferred features depicted in FIGS. 1 and 2 include the provision of an elongated mounting plate 15 above a substantial portion of shaft housing 22. Plate 15 is placed against the bottom of a flat bottom boat so that the propeller is below but close to the rear transom of the boat, and the overall mechanism of this invention is then bolted to the boat through apertures in plate 15 and the bottom of the boat. It will thus be appreciated that shaft housing 22 extends up into the boat through a suitable opening in the boat which is covered by plate 15. Keel or rod 17 which may be square, round, or etc. and either solid or hollow, is preferably about ⅝ to ¾ inch in cross-section. It declines rearwardly somewhat more than angle alpha and thus as the boat is propelled forwardly, rod 17 tends to impose an upward lift in the event a submerged stump or other obstacle is encountered. Upper vertical plate 19 provides connection between the median lower portion of mounting plate 15 and the median upper portion of shaft housing 22. Lower vertical plate 21 provides connection between the lower median portion of shaft housing 22 and the median upper portion of rod 17.

As can be seen from FIGS. 1 and 2, affixed to the rearward portion of shaft housing 22 are a pair of elongated triangular fins 23,23 which extend radially outwardly from opposite sides of the exterior of housing 22. As depicted in FIG. 2, each such fin provides in profile (i.e., when viewed from above) an inclined plane of progressively increasing height terminating in front of and in proximity to the transverse circular locus of rotation of blades 46,46. The apex of this triangular profile extends (as depicted) to at least about the midpoint of the radial length of the blades to the extent they project from hub 45. These fins assist in preventing fouling when operating in marshy areas thick with grasses and other plant life.

The boat itself may be made of metal such as aluminum, plastics, laminates, wood, composites, or the like.

FIGS. 31 through 35 illustrate the utilization of the variable pitch blades, pitch adjusting systems and propulsion or drive systems of this invention in stern drive systems, and ways by which such systems can be coupled therein and operated therewith. In the form depicted in FIG. 31, hub 45 equipped as described hereinabove with, inter alia, recesses 77, blades 46, and hollow drive shaft 14 is connected to a second rotatable drive shaft 105 by means of a set of matching bevel gears 107. Thus rotation of shaft 105, which is angularly disposed relative to shaft 14 (preferably but not necessarily by about 90°), causes rotation of shaft 14, hub 45 and blades 46. Such rotation of shaft 105 can be effected by rotary power from an outboard motor as indicted by FIG. 32 or from an inboard motor power train as indicated by FIGS. 33 and 35. The system depicted in FIG. 31 also includes pitch adjusting shaft 26 which when linearly moved within hollow drive shaft 14 causes the pitch of blades 46 to be changed, all as described more fully hereinabove such as in connection with FIGS. 10–12. The embodiment illustrated in FIG. 31 differs however in that the forward portion of shaft 26 is connected to pitch control rod 109, which is angularly disposed (preferably but not necessarily by about 90°) from shaft 26, by means of pivot connector 115. Connector 115 in the form depicted is L-shaped and pivots on stationary axis 117. The connection between rod 109 and connector 115 is effected by a pin or rivet 113 on which connector 115 can rotate so that linear movement of rod 109 causes connector 115 to pivot on axis 117. The connection between connector 115 and shaft 26 also involves rotation on a pin or rivet 116 but additionally involves the provision of a linear slot 119 in connector 115 to allow pin or rivet 116 to slide therein so that downward linear movement of rod 109 is translated into rearward linear movement of shaft 26 whereas upward linear movement of rod 109 is translated into forward linear movement of shaft 26. As indicted in FIG. 31, hollow drive shaft 14 rotates in bearings or bushings 28. In addition, as indicated by FIG. 31, the lower portion of the stern drive system just described (except for hub 45 and blades 46) is preferably encased in a downwardly extending casing 120, the lower portion of which terminates in a smoothly curved, rearwardly extending section which serves as a skeg to protect the hub and blades against striking submerged obstacles and to enable the entire unit either to ride upwardly over such an obstacle or to pivot upwardly over such obstacle, depending on whether or not the unit is pivotally mounted on or in the boat.

As also indicated by FIG. 31, it is desirable to include one or more laterally extending fins or plates 122 projecting rearwardly above hub 45 and blades 46. During forward operation of the boat, such fin or plate keeps the rearwardly thrusted water from excessively breaking the surface. In other words, the fin or plate retains the "wheel wash" below the surface of the water and thereby enables the boat to receive a suitably strong forward thrust.

FIG. 32 illustrates the use of a system such as that of FIG. 31 in an outboard motor unit. In essence, shaft 105 is operatively linked and rotated in any well-known manner to the outboard motor 103, thus causing by virtue of the linkage described above, rotation of hub 45 and blades 46 to propel the boat. Likewise, pitch control rod 109 extends upwardly to a suitable control system so that rod 109 can be moved linearly to whatever extent and in whichever direction desired. Linkage to shaft 26, such as of the type described above in connection with FIG. 31, thus enables the pitch of blades 46 to be adjusted by the operator through use of the control system (e.g., a pivoted shift lever with or without stops, a push-pull button, or the like).

FIG. 33 illustrates the use of a system such as that of FIG. 31 in an inboard motor unit. In essence, the power train involves hollow drive shaft 14 rotatably connected to a second rotatable drive shaft 105 (e.g., by means of a set of matching bevel gears 107 as described above), which in turn is rotably connected (e.g., by another set of bevel gears 107 or the like) to a third rotatable drive shaft 130. As FIG. 33 indicates, in this particular type of system shaft 105 is angularly disposed relative to shaft 14 (preferably by 90°), and shaft 130 is angularly disposed relative to shaft 105 (also preferably by 90°). Shaft 130 is operatively connected to and rotated by inboard motor 135. Thus rotation of shaft 130 is translated through the system to cause rotation of hub 45 and blades 46. As also indicated by FIG. 33, pitch adjusting shaft 26 is connected to pitch control rod 109, for example by means of a pivot connector 115. If desired, pitch control shaft 140 can in turn be connected to control rod 109 such as by use of another pivot connector 115. Thus linear movement of control rod 109 (and shaft 140 if used) is translated into linear movement of shaft 26 and consequent adjustment of the blades. Such linear movement can be initiated by the operator by means of suitably positioned controls such as a pivoted shift lever with or without stops, a push-pull button, or the like.

As noted above, the fragmentary schematic view in FIG. 34 depicts a portion of a stern drive system illustrating the principle of using a locking mechanism when the pitch of the blades is being adjusted to propel the boat in a reverse direction. Unless the stern drive is fixedly attached to the boat so that it will not be free to pivot rearwardly and upwardly if a submerged obstacle is struck, a suitable locking mechanism should be included in the system. The purpose of the locking mechanism is to prevent, when the pitch of the blades is changed to reverse, rearward and upward pivotal movement of the portion of the stern drive system that is pivotally supported on the boat for preventing or minimizing damage in the event a submerged obstacle is encountered during forward travel. In the interest of simplification and ease of understanding, the locking mechanism depicted in FIG. 34 is merely a pivoted hook and eye mechanism 125 which is engaged manually just before shifting the pitch of the blades into reverse. This will prevent upward and rearward pivoting of stern drive system 127 on axis 123. Although system 127 is depicted in FIG. 34 as an outboard motor unit, it will be understood and appreciated that for the same reasons as just described, a suitable locking system should also be utilized in an inboard stern drive system having a portion thereof (including the portion that is submerged in the water) pivotally supported relative to the boat to prevent or minimize propeller damage, etc. in the event a submerged obstacle is encountered during forward travel. It will also be understood and appreciated that with pivotably supported stern drive systems, whether of the outboard motor type or of the inboard motor type, the locking mechanism utilized can be automatically actuated as the controls are being applied to change the pitch of the blades to a reverse drive position. The locking mechanism itself can be a hydraulically operated system, an electrically operated system, or a mechanically operated system. Whatever the construction of the locking system, its purpose is to lock the pivotable portion of the stern drive unit in place when causing the boat to shift into a reverse drive. When the boat is being propelled in a forward direction, the locking mechanism is inoperative. Locking mechanism systems which can be utilized in stern drive systems of this invention are in commercial use with conventional propulsion systems, and thus details of their construction and operation are known to those skilled in the relevant art.

FIG. 35 illustrates, inter alia, a typical mechanism which can be used for converting rotary motion from one drive shaft to another drive shaft angularly disposed therefrom, and a flexible coupling which permits the angular disposition between a pair of such rotatable drive shafts to change in the event a force is applied (e.g., a force resulting from encountering or striking a submerged obstacle) tending to change the angular displacement of between such drive shafts. In particular, bevel gears 107 are disposed between second drive shaft 105 and hollow drive shaft 14 and between second drive shaft 105 and third drive shaft 130 so that rotation of shaft 130 is translated into rotation of shafts 105 and 14 and of hub 45 and blades 46. The flexible coupling 145 depicted is a double universal joint, which is the preferred type of flexible coupling used in the pivotally supported stern drive systems of this invention. However, if desired, a single universal joint or coupling, or other flexible coupling mechanism can be used. Flexible coupling 145 transmits the rotation from the inboard motor or engine to shaft 130 and, as explained above, permits casing 120 (note FIG. 31) to pivot upwardly and rearwardly when a submerged obstacle is encountered. Strictly speaking, because coupling 145 is disposed intermediate the ends of shaft 130, the angular disposition that is changed when a submerged obstacle is encountered is the angular disposition between second drive shaft 105 and that portion of shaft 130 that is disposed in front of (i.e., upstream from) coupling 145. FIG. 35 also illustrates the use of two pivot connectors 115, one between pitch control shaft 140 and pitch control rod 109, and the other between pitch control rod 109 and pitch adjusting shaft 26. Thus with the arrangement as depicted, forward linear movement of shaft 140 is translated into upward linear movement of rod 109 and forward linear movement of shaft 26. Conversely, rearward linear movement of shaft 140 is translated into downward linear movement of rod 109 and rearward linear movement of shaft 26. Thus the pitch of the blades is readily adjusted from full forward to neutral to full reverse (and vice versa) and to various positions therebetween.

Boats equipped with systems of this invention are generally operated at conventional engine speeds, e.g., about 2500 to about 3200 rpm, and at slower idle speeds. Among the advantages of this invention is the fact that the system may be shifted very easily, smoothly, and rapidly from full speed forward to full speed reverse without changing engine speed—none of this is possible with conventionally equipped power boats.

This invention thus makes possible the following advantages:

1) Fouling of propeller blades can be avoided even when operating in thickly vegetated marshy areas.
2) Boats can be maneuvered such that they can extricate themselves from mud and vegetated areas in which conventional boats would become mired and bogged down.

3) Boats can be operated at a wide range of speeds, both in forward and in reverse.
4) Boats can be stopped easily, rapidly and smoothly, and can be caused to reverse directions, all without changing engine speed.
5) Systems can be provided in which conventional restrain means for the pitch control lever need not be used.
6) Durable systems easy to service and maintain can be provided.
7) Very quiet boat operation is readily achieved.
8) Ordinary low to medium horsepower engines can be used.
9) Systems can be provided which do not occupy much boat space.

This invention is susceptible to considerable variation in its practice and it is not intended that it be limited by the illustrative embodiments described herein. Rather, this invention is embodied in the spirit and scope of the ensuing claims.

What is claimed is:

1. A variable pitch propeller and adjusting mechanism which comprises:
a) a hollow hub having disposed at locations exterior perimeter thereof a plurality of arcuate recesses; and having disposed on and extending from the hub a plurality of unitary propeller blades, each such propeller blade having (i) a planar configuration, (ii) an inner end portion, (iii) an outer end portion, (iv) a relatively sharp, outwardly swept back leading edge portion, and (v) a cylindrical stub axially aligned with the plane of the blade and affixed to the inner end portion of the blade, each said stub being adapted upon axial rotation to rotate the entire unitary blade to which it is affixed, the respective stubs of the blades extending radially into the hollow portion of the hub and adapted for axial rotation, at least the innermost end of the leading edge portion of the respective blades being disposed in and adapted for arcuate movement within at least a substantial portion of the respective arcuate recesses upon axial rotation of the respective stubs;
b) a pitch adjusting shaft axially aligned with and adapted to undergo linear motion relative to said hub;
c) means translating linear motion of said pitch adjusting shaft into opposed rotational movement of said stubs so that the pitch of the blades can be adjusted by such rotational movement of said stubs;
d) a pitch control rod adapted to undergo linear motion, said pitch control rod being angularly disposed relative to said pitch adjusting shaft; and
e) means for converting linear motion of said pitch control rod into linear motion of said pitch adjusting shaft.

2. Apparatus according to claim 1 wherein the axis of said pitch control rod is angularly disposed at essentially 90° relative to the axis of said pitch adjusting shaft.

3. Apparatus according to claim 1 further including:
f) a pitch control shaft adapted to undergo linear motion and angularly disposed relative to said pitch control rod; and
g) means for converting linear motion of said pitch control shaft into linear motion of said pitch control rod.

4. Apparatus according to claim 3 wherein the axis of said pitch control rod is angularly disposed at essentially 90° relative to the axis of said pitch adjusting shaft.

5. In a stern drive propulsion system for a boat, which propulsion system comprises at least one prime mover and at least one power train for rotating at least one propeller below the surface of the water in order to propel the boat, the improvement wherein said propulsion system includes a variable pitch propeller and adjusting mechanism which comprises:
a) hollow hub having disposed at locations around the exterior perimeter thereof a plurality of arcuate recesses; and having disposed on and extending from the hub a plurality of unitary propeller blades, each such propeller blade having (i) a planar configuration, (ii) an inner end portion, (iii) an outer end portion, (iv) a relatively sharp, outwardly swept back leading edge portion, and (v) a cylindrical stub axially aligned with the plane of the blade and affixed to the inner end portion of the blade, each said stub being adapted upon axial rotation to rotate the entire unitary blade to which it is affixed, the respective stubs of the blades extending radially into the hollow portion of the hub and adapted for axial rotation, at least the innermost end of the leading edge portion of the respective blades being disposed in and adapted for arcuate movement within at least a substantial portion of the respective arcuate recesses upon axial rotation of the respective stubs;
b) a pitch adjusting shaft axially aligned with and adapted to undergo linear motion relative to said hub;
c) means translating linear motion of said pitch adjusting shaft into opposed rotational movement of said stubs so that the pitch of the blades can be adjusted by such rotational movement of said stubs;
d) a pitch control rod adapted to undergo linear motion, said pitch control rod being angularly disposed relative to said pitch adjusting shaft; and
e) means for converting linear motion of said pitch control rod into linear motion of said pitch adjusting shaft.

6. Apparatus according to claim 5 wherein the axis of said pitch control rod is angularly disposed at essentially 90° relative to the axis of said pitch adjusting shaft.

7. Apparatus according to claim 5 further including:
f) a pitch control shaft adapted to undergo linear motion and angularly disposed relative to said pitch control rod; and
g) means for converting linear motion of said pitch control shaft into linear motion of said pitch control rod.

8. Apparatus according to claim 7 wherein the axis of said pitch control rod is angularly disposed at essentially 90° relative to the axis of said pitch adjusting shaft.

9. In a stern drive propulsion system for a boat, which propulsion system comprises at least one prime mover and at least one power train for rotating at least one propeller below the surface of the water in order to propel the boat, the improvement wherein said propulsion system includes:
a) a rotatable hollow drive shaft having a hollow hub affixed thereto, said hub having disposed at locations around the exterior perimeter thereof a plurality of arcuate recesses; and having disposed on and extending from the hub a plurality of unitary propeller blades, each such propeller blade having (i) a planar configuration, (ii) an inner end portion, (iii) an outer end portion, (iv) a relatively sharp, outwardly swept back leading edge portion, and (v) a cylindrical stub axially aligned with the plane of the blade and affixed to the inner end portion of the blade, each said stub being adapted upon axial rotation to rotate the entire unitary blade to which it is affixed, the respective stubs of the blades extending radially into the hollow portion of the hub and adapted for axial rotation, at least the innermost end of the leading edge portion of the respective blades being disposed in and adapted for arcuate movement within at least a substantial portion of the respective arcuate recesses upon axial rotation of the respective stubs;

b) a pitch adjusting shaft disposed in said hollow drive shaft and longitudinally moveable therein, said pitch adjusting shaft being axially aligned with and adapted to undergo linear motion relative to said hub;

c) means translating linear motion of said pitch adjusting shaft into opposed rotational movement of said stubs so that the pitch of the blades can be adjusted by such rotational movement of said stubs;

d) a pitch control rod adapted to undergo linear motion, said pitch control rod being angularly disposed relative to said pitch adjusting shaft;

e) means for converting linear motion of said pitch control rod into linear motion of said pitch adjusting shaft;

f) a second rotatable drive shaft, said second rotatable drive shaft being angularly disposed relative to said hollow drive shaft; and g) means for converting rotary motion of said second rotatable drive shaft into rotary motion of said hollow drive shaft to thereby cause rotation of said hub.

10. Apparatus according to claim 9 wherein the axis of said second rotatable drive shaft is angularly disposed at essentially 90° relative to the axis of said hollow drive shaft.

11. Apparatus according to claim 9 wherein the prime mover is at least one outboard motor mountable on the transom of the boat and wherein said second rotatable drive shaft is rotatable by rotational energy supplied by said outboard motor.

12. Apparatus according to claim 11 wherein the axis of said second rotatable drive shaft is angularly disposed at essentially 90° relative to the axis of said hollow drive shaft.

13. Apparatus according to claim 9 further including:

h) a pitch control shaft adapted to undergo linear motion and angularly disposed relative to said pitch control rod; and i) means for converting linear motion of said pitch control shaft into linear motion of said pitch control rod.

14. Apparatus according to claim 9 further including:

h) a third rotatable drive shaft angularly disposed relative to said second rotatable drive shaft;

i) means for converting rotary motion of said third rotatable drive shaft into rotary motion of said second rotatable drive shaft; and j) means permitting the angular disposition between said second rotatable drive shaft and at least a portion of said third rotatable drive shaft to change in the event an obstacle is encountered tending to change the angular displacement of said second rotatable drive shaft relative to said third rotatable drive shaft.

15. Apparatus according to claim 14 wherein the axis of said second rotatable drive shaft is angularly disposed at essentially 90° relative to the axis of said hollow drive shaft.

16. Apparatus according to claim 14 wherein the prime mover is an inboard motor mountable within the boat and wherein said third rotatable drive shaft is rotatable by rotational energy supplied thereto by the inboard motor.

17. Apparatus according to claim 9 further including:

h) a pitch control shaft adapted to undergo linear motion and angularly disposed relative to said pitch control rod;

i) means for converting linear motion of said pitch control shaft into linear motion of said pitch control rod;

j) a third rotatable drive shaft angularly disposed relative to said second rotatable drive shaft;

k) means for converting rotary motion of said third rotatable drive shaft into rotary motion of said second rotatable drive shaft; and l) means permitting the angular disposition between said second rotatable drive shaft and at least a portion of said third rotatable drive shaft to change in the event an obstacle is encountered tending to change the angular displacement of said second rotatable drive shaft relative said third rotatable drive shaft.

18. Apparatus according to claim 17 wherein the axis of said second rotatable drive shaft is angularly disposed at essentially 90° relative to the axis of said hollow drive shaft.

19. Apparatus according to claim 17 wherein the prime mover is an inboard motor mountable within the boat and wherein said third rotatable drive shaft is rotatable by rotational energy supplied thereto by the inboard motor.

20. Apparatus according to claim 9 wherein said hub has two said arcuate recesses disposed on opposite sides of the hub, and is equipped with a pair of said unitary propeller blades.

21. Apparatus according to claim 20 wherein each said unitary propeller blade has (a) a relatively thick or blunt trailing edge portion, (b) generally flat surfaces between the leading edge portion and the trailing edge portion, and (c) a planar configuration which falls entirely along a single flat plane.

22. Apparatus according to claim 21 wherein each said unitary propeller blade has a leading edge portion that is no more than about 1/32 of an inch in thickness, and a trailing edge portion that is in the range of from about $\frac{1}{8}$ to about $\frac{3}{8}$ of an inch in thickness.

23. Apparatus according to claim 21 wherein each said unitary propeller blade has a facial area in the range of about 6 to about 25 square inches per blade side.

24. Apparatus according to claim 23 wherein each said unitary propeller blade has a leading edge portion that is no more than about 1/32 of an inch in thickness.

25. Apparatus according to claim 14 wherein said hub has two said arcuate recesses disposed on opposite sides of the hub, and is equipped with a pair of said unitary propeller blades.

26. Apparatus according to claim 25 wherein each said unitary propeller blade has (a) a relatively thick or blunt trailing edge portion, (b) generally flat surfaces between the leading edge portion and the trailing edge portion, and (c) a planar configuration which falls entirely along a single flat plane.

27. Apparatus according to claim 26 wherein each said unitary propeller blade has a leading edge portion that is no more than about 1/32 of an inch in thickness, and a trailing edge portion that is in the range of from about $\frac{1}{8}$ to about $\frac{3}{8}$ of an inch in thickness.

28. Apparatus according to claim 26 wherein each said unitary propeller blade has a facial area in the range of about 6 to about 25 square inches per blade side.

29. Apparatus according to claim 28 wherein each said unitary propeller blade has a leading edge portion that is no more than about 1/32 of an inch in thickness.

* * * * *